US008322712B2

(12) United States Patent
Funayanagi et al.

(10) Patent No.: US 8,322,712 B2
(45) Date of Patent: Dec. 4, 2012

(54) SHEET MATERIAL TRANSPORTING DEVICE AND IMAGE FORMING DEVICE

(75) Inventors: Masaru Funayanagi, Kanagawa (JP); Toshiyuki Miyata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 326 days.

(21) Appl. No.: 12/853,722

(22) Filed: Aug. 10, 2010

(65) Prior Publication Data

US 2011/0135363 A1 Jun. 9, 2011

(30) Foreign Application Priority Data

Dec. 8, 2009 (JP) ..... 2009-278648

(51) Int. Cl.
*B65H 29/32* (2006.01)

(52) U.S. Cl. ..... 271/197; 271/198; 271/194; 399/397

(58) Field of Classification Search ..... 271/194, 271/196, 197, 198, 275, 276; 399/397; 198/817, 198/832.1, 835
See application file for complete search history.

(56) References Cited

U.S. PATENT DOCUMENTS 1,891,782 A * 12/1932 Sager ..... 38/143
4,275,977 A * 6/1981 Joice ..... 414/790.9
4,470,591 A * 9/1984 Acquaviva ..... 271/245
4,651,984 A * 3/1987 Emrich ..... 271/237
5,063,415 A * 11/1991 Ariyama ..... 399/400
5,139,253 A * 8/1992 Bohme et al. ..... 271/197
5,193,423 A * 3/1993 Bakker ..... 83/24
6,293,544 B1 * 9/2001 Fedinatz ..... 271/243
7,896,332 B2 * 3/2011 Terao ..... 270/58.11
8,113,515 B2 * 2/2012 Komiyama et al. ..... 271/276
2003/0173734 A1 * 9/2003 Wong et al. ..... 271/198

FOREIGN PATENT DOCUMENTS

JP A-2007-302406 11/2007

* cited by examiner

*Primary Examiner* — Kaitlin Joerger
*Assistant Examiner* — Ernesto Suarez
(74) *Attorney, Agent, or Firm* — Oliff & Berridge, PLC

(57) ABSTRACT

A sheet-material transporting device includes: plural first endless-belts; a driving-member around which the first endless-belts are trained to circulate; a first driven-member around which the first endless-belts are trained, being slave-rotated; a supporting-member provided at an inner-peripheral-side of the first endless-belts; a second endless-belt provided between the first endless-belts, trained around the driving-member and circulating; a second driven-member provided between the first driven-member and the driving-member, around which the second endless-belt is trained at an opening portion provided in the supporting-member, being slave-rotated; and a detecting-member detecting a sheet-material, the supporting-member including a downstream-side-supporting-member disposed at a downstream-side having a concave-portion formed in an end portion, and an upstream-side-supporting-member disposed at an upstream-side and that is set against the end portion of the downstream-side-supporting-member such that the concave portion forms the opening portion, and a tension-imparting section imparting tension to the second endless-belt being provided at the downstream-side-supporting-member.

16 Claims, 25 Drawing Sheets

FIG. 16

| SHEET TYPE | SHEET WIDTH | SHEET BASIS WEIGHT | AMOUNT OF AIR |
|---|---|---|---|
| ORDINARY PAPER EMBOSSED PAPER | LARGE | SMALL | 6 |
| | | MEDIUM | 5 |
| | | LARGE | 5 |
| | SMALL | SMALL | 6 |
| | | MEDIUM | 5 |
| | | LARGE | 5 |
| COATED PAPER CAST PAPER | LARGE | SMALL | 5 |
| | | MEDIUM | 4 |
| | | LARGE | 4 |
| | SMALL | SMALL | 6 |
| | | MEDIUM | 5 |
| | | LARGE | 5 |

SHEET MATERIAL TRANSPORTING DEVICE AND IMAGE FORMING DEVICE

CROSS-REFERENCE TO RELATED APPLICATION

This application is based on and claims priority under 35 USC 119 from Japanese Patent Application No. 2009-278648 filed Dec. 8, 2009.

BACKGROUND

Technical Field

The present invention relates to a sheet material transporting device and an image forming device.

SUMMARY

A sheet material transporting device of an aspect of the present invention includes: plural first endless belts that is formed by band-shaped material; a driving member that, by rotating, circulates the first endless belts, the plural first endless belts being looped around the driving member and aligned in an axial direction of the driving member; a first driven member that is slave-rotated in conjunction with circulation of the first endless belts, the plural first endless belts being looped around the first driven member and aligned in an axial direction of the first driven member; a supporting member that supports the driving member at a downstream side in a sheet material transporting direction and the first driven member at an upstream side in the sheet material transporting direction, the supporting member being provided at an inner peripheral side of the first endless belts; a second endless belt that is provided between the first endless belts and circulated by the driving member, the second endless belt being formed by a band-shaped material and looped around the driving member; a second driven member that is provided between the first driven member and the driving member and slave-rotated in conjunction with circulation of the second endless belt, the second endless belt being looped around the second driven member at an opening portion of the supporting member; and a detecting member that detects a sheet material that is transported, the detecting member being provided between the first driven member and the second driven member and between the first endless belts, and being fixed to the supporting member, wherein the supporting member includes a downstream side supporting member that is disposed at a downstream side in the sheet material transporting direction and has a concave portion formed in an end portion thereof, and an upstream side supporting member that is disposed at an upstream side in the sheet material transporting direction and abutted against the end portion of the downstream side supporting member such that the concave portion forms the opening portion, and a tension imparting section that imparts tension to the second endless belt is provided at the downstream side supporting member.

BRIEF DESCRIPTION OF THE DRAWINGS

Exemplary embodiments of the invention will be described in detail with reference to the following figures, wherein:

FIG. 16 is a table showing the amount of air of fans employed in the sheet material transporting device relating to the exemplary embodiment of the present invention;

DETAILED DESCRIPTION

Figure 1:
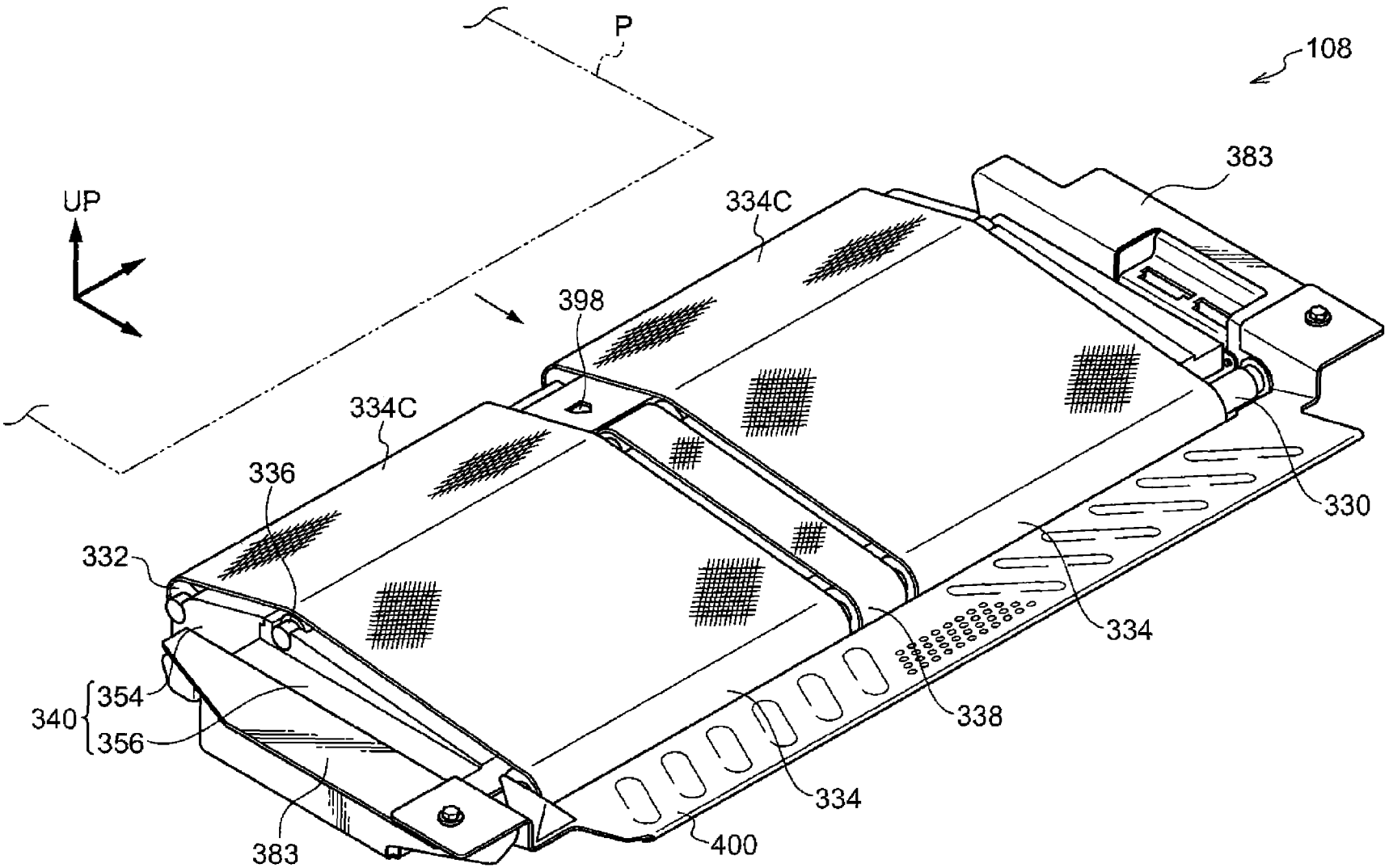
FIG. 1 is a perspective view showing a sheet material transporting device relating to an exemplary embodiment of the present invention.

Examples of a sheet material (sheet member) transporting device and an image forming device relating to exemplary embodiments of the present invention are described in accordance with FIG. 1 through FIG. 25. Note that arrow UP shown in the drawings indicates upward in the vertical direction.

(Overall Structure)

Figure 19:
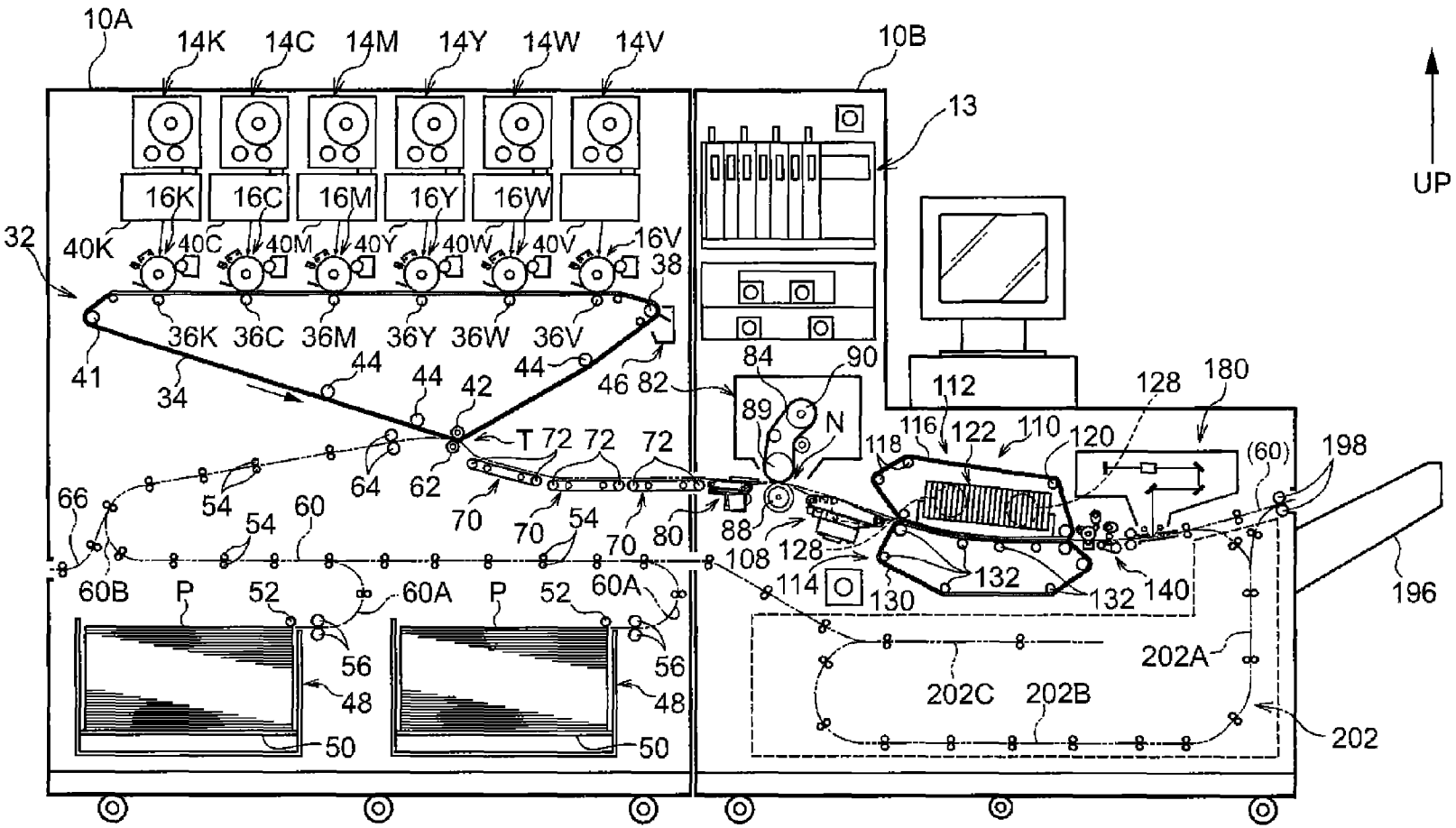
FIG. 19 is a schematic structural drawing showing the image forming device relating to the exemplary embodiment of the present invention.

An image forming device 10 relating to the present exemplary embodiment forms full-color images or black-and-white images. As shown in FIG. 19, the image forming device 10 has a first housing 10A in which is accommodated a first processing section that structures one side portion in the horizontal direction (the left side portion in FIG. 19), and a second housing 10B in which is accommodated a second processing section that structures the other side portion in the horizontal direction (the right side portion in FIG. 19).

An image signal processing section 13, that carries out image processings on image data that is sent-in from an external device such as a computer or the like, is provided in the upper portion of the second housing 10B.

On the other hand, toner cartridges 14V, 14W, 14Y, 14M, 14C, 14K, that accommodate respective toners of a first special color (V), a second special color (W), yellow (Y), magenta (M), cyan (C), black (K), are replaceably provided in the upper portion of the first housing 10A along the horizontal direction.

Note that the first special color and the second special color are appropriately selected from colors (including transparent) other than yellow, magenta, cyan and black. Further, in the following description, when differentiating among the first special color (V), the second special color (W), yellow (Y), magenta (M), cyan (C) and black (K) for the respective structural parts, the corresponding letter V, W, Y, M, C, K is appended to the reference numeral. If not differentiating among the first special color (V), the second special color (W), yellow (Y), magenta (M), cyan (C) and black (K), the letter V, W, Y, M, C, K, is omitted.

Six image forming units 16 corresponding to the toners of the respective colors are provided along the horizontal direction beneath the toner cartridges 14, so as to correspond to the respective toner cartridges 14.

Figure 18:
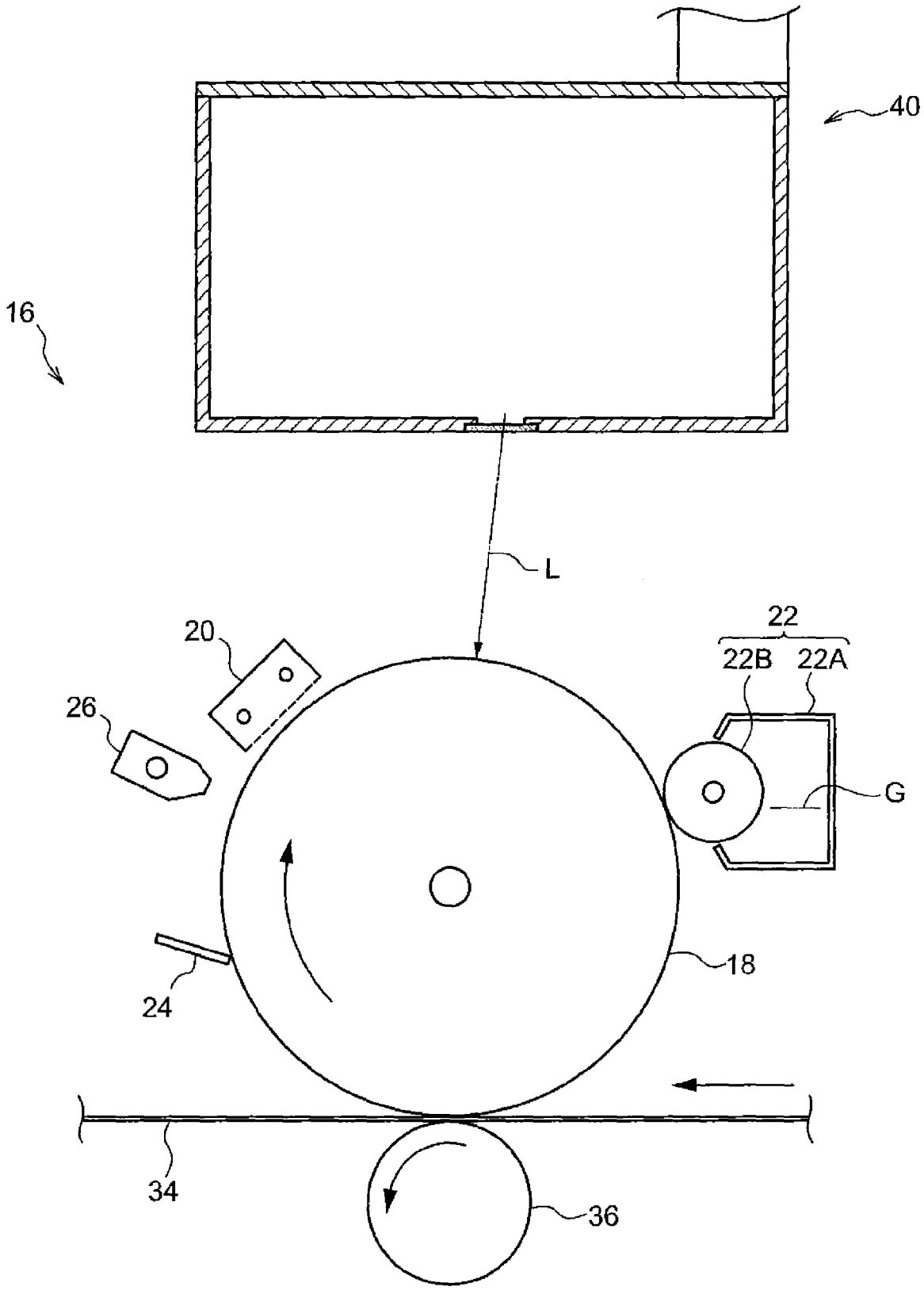
FIG. 18 is a schematic structural drawing showing an image forming unit employed in an image forming device relating to an exemplary embodiment of the present invention.

An optical scanner 40, that is provided for each of the image forming units 16, is structured so as to receive, from the aforementioned image signal processing section 13, image data that has been subjected to an image processing by the image signal processing section 13, and illuminate a light beam L, that is modulated in/accordance with this image data, onto an image carrier 18 that is described hereafter (refer to FIG. 18).

As shown in FIG. 18, each of the image forming units 16 has the image carrier 18 that is driven and rotated in one direction (clockwise in FIG. 18). Due to the light beam L being illuminated from the optical scanner 40 onto the image carrier 18, an electrostatic latent image is formed on the image carrier 18.

Provided at the periphery of the image carrier 18 are: a corona discharge type (non-contact charging type) scorotron charger 20 that serves as an example of a charging device that charges the image carrier 18; a developing device 22 that develops, by a developer, the electrostatic latent image that is formed on the image carrier 18 by the optical scanner 40; a blade 24 serving as a removing member that removes the developer remaining on the image carrier 18 after transfer; and an eraser 26 that carries out erasing of charge by illuminating light onto the image carrier 18 after transfer.

The scorotron charger 20, the developing device 22, the blade 24 and the eraser 26 are disposed so as to face the surface of the image carrier 18, in that order from the rotating direction upstream side of the image carrier 18 toward the downstream side.

The developing device 22 is structured to include a developer accommodating member 22A that accommodates a developer G containing toner, and a developing roller 22B that supplies, to the image carrier 18, the developer G that is accommodated in the developer accommodating member 22A. The developer accommodating member 22A is connected to the toner cartridge 14 (see FIG. 19) through a toner supply path (not shown), and toner is supplied from the toner cartridge 14.

As shown in FIG. 19, a transfer section 32 is provided beneath the respective image forming units 16. The transfer section 32 is structured to include an intermediate transfer belt 34 that is annular and contacts the respective image carriers 18, and first transfer rollers 36 serving as first transfer members that transfer, in a superposed manner and onto the intermediate transfer belt 34, the toner images that are formed on the respective image carriers 18.

The intermediate transfer belt 34 is trained (looped) around a driver roller 38 that is driven by an unillustrated motor, a tension imparting roller 41 that imparts tension to the intermediate transfer belt 34, an opposing roller 42 that opposes a second transfer roller 62 that will be described hereinafter, and plural training rollers 44. The intermediate transfer belt 34 is circulated in one direction (counterclockwise in FIG. 19) by the driver roller 38.

The respective first transfer rollers 36 are disposed so as to oppose the image carriers 18 of the respective image forming units 16, with the intermediate transfer belt 34 nipped therebetween. A transfer bias voltage, that is the opposite polarity of the toner polarity, is applied to the first transfer rollers 36 by an electricity supplying section (not shown). Due to this structure, the toner images formed on the image carriers 18 are transferred onto the intermediate transfer belt 34.

A removing device 46, that causes a blade to contact the intermediate transfer belt 34 and removes residual toner, paper dust, and the like that are on the intermediate transfer belt 34, is provided at the opposite side of the driver roller 38 with the intermediate transfer belt 34 sandwiched therebetween.

Two recording media accommodating sections 48, that accommodate recording media P such as sheets or the like that are examples of sheet materials (sheet members), are provided along the horizontal direction beneath the transfer section 32.

The recording media accommodating sections 48 can be pulled-out freely from the first housing 10A. A feed-out roller 52, that feeds the recording medium P out from the recording media accommodating section 48 to a transporting path 60, is provided above one end side (the right side in FIG. 19) of each of the recording media accommodating sections 48.

A bottom plate 50 on which the recording media P are placed is provided within each of the recording media accommodating sections 48. When the recording media accommodating section 48 is pulled-out from the first housing 10A, the bottom plate 50 is lowered due to the instruction of an unillustrated controller. Due to the bottom plate 50 being lowered, a space into which a user replenishes the recording media P is formed in the recording media accommodating section 48.

When the recording media accommodating section 48 that has been pulled-out from the first housing 10A is set in the first housing 10A, the bottom plate 50 rises up due to the instruction of the controller. Due to the bottom plate 50 rising up, the uppermost recording medium P that is set on the bottom plate 50 and the feed-out roller 52 contact one another.

Separating rollers 56, that separate one-by-one the recording media P that are fed-out from the recording media accommodating section 48 in a state of being superposed one another, are provided at the recording medium transporting direction downstream side (hereinafter simply called "downstream side" upon occasion) of the feed-out roller 52. Plural transporting rollers 54, that transport the recording medium P to the transporting direction downstream side, are provided at the downstream side of the separating rollers 56.

The transporting path 60, that is provided between the recording media accommodating sections 48 and the transfer section 32, extends to a transfer position T between the second transfer roller 62 and the opposing roller 42, so as to turn the recording medium P, that is fed-out from the recording media accommodating section 48, back toward the left side in FIG. 19 at a first turn-back section 60A, and further, turn the recording medium P back toward the right side in FIG. 19 at a second turn-back section 60B.

A transfer bias voltage of the opposite polarity as the toner polarity is applied by an electricity supplying section (not shown) to the second transfer roller 62. Due to this structure, the toner images of the respective colors, that have been transferred onto the intermediate transfer belt 34 so as to be superposed one on another, are second-transferred, by the second transfer roller 62, onto the recording medium P that is transported-in along the transporting path 60.

A spare path 66 that extends from the side surface of the first housing 10A is provided so as to merge into the second turn-back portion 60B of the transfer path 60. The recording medium P, that is fed-out from another recording media accommodating section (not shown) that is disposed adjacent to the first housing 10A, is fed-into the transporting path 60 through the spare path 66.

Plural transporting belts 70, that transport the recording medium P on which the toner image has been transferred toward the second housing 10B, are provided in the first housing 10A at the downstream side of the transfer position T. A sheet material transporting device 80, that transports downstream the recording medium P that has been transported by the transporting belts 70, is provided in the second housing 10B.

Each of the plural transporting belts 70 is formed in an annular shape and is trained around a pair of training rollers 72. The pair of training rollers 72 are disposed at the recording medium P transporting direction upstream side (hereinafter simply called "upstream side"' upon occasion) and downstream side, respectively. Due to one of the training rollers 72 being driven to rotate, the transporting belt 70 is circulated in one direction (clockwise in FIG. 19).

The sheet material transporting device 80, that is provided at the recording medium P transporting direction downstream side with respect to the transporting belts 70, transports the recording medium P to a fixing unit 82 that serves as an example of a fixing section that fixes the toner image that has been transferred onto the surface of the recording medium P, to the recording medium P by heat and pressure.

The fixing unit 82 has a fixing belt 84 and a pressure-applying roller 88 that is disposed so as to contact the fixing belt 84 from the lower side thereof. A fixing portion N, at which pressure is applied to the recording medium P and the recording medium P is heated such that the toner image is fixed thereon, is formed between the fixing belt 84 and the pressure-applying roller 88.

The fixing belt 84 is formed in an annular shape, and is trained around a driver roller 89 and a driven roller 90. The driver roller 89 opposes the pressure-applying roller 88 from the upper side thereof, and the driven roller 90 is disposed further toward the upper side than the driver roller 89.

A heating portion, such as a halogen heater or the like, is incorporated in each of the driver roller 89 and the driven roller 90. The fixing belt 84 is heated thereby.

As shown in FIG. 19, a sheet material transporting device 108, that transports the recording medium P that is fed-out from the fixing unit 82, is provided at the recording medium P transporting direction downstream side with respect to the fixing unit 82.

Details of the sheet material transporting device 80 and the sheet material transporting device 108 will be described hereinafter.

A cooling unit 110, that cools the recording medium P that has been heated by the fixing unit 82, is provided at the downstream side of the sheet material transporting device 108.

The cooling unit 110 has an absorbing device 112 that absorbs the heat of the recording medium P, and a pushing device 114 that pushes the recording medium P against the absorbing device 112. The absorbing device 112 is disposed at one side of the transporting path 60 (the upper side in FIG. 19), and the pushing device 114 is disposed at the other side (the lower side in FIG. 19).

The absorbing device 112 has an absorbing belt 116 that is annular and contacts the recording medium P and absorbs the heat of the recording medium P. The absorbing belt 116 is trained around a driver roller 120 that transmits driving force to the absorbing belt 116, and plural training rollers 118.

A heat sink 122, that is formed of an aluminum material and planarly contacts the absorbing belt 116 and dissipates the heat that the absorbing belt 116 has absorbed, is provided at the inner peripheral side of the absorbing belt 116.

Fans 128, for taking heat from the heat sink 122 and exhausting hot air to the exterior, are disposed at the reverse side of the second housing 10B (the far side in the depthwise direction of FIG. 19).

The pushing device 114, that pushes the recording medium P against the absorbing device 112, has a pushing belt 130 that is annular and transports the recording medium P while pushing the recording medium P against the absorbing belt 116. The pushing belt 130 is trained around plural training rollers 132.

A correcting device 140, that nips and transports the recording medium P and corrects the curving (curling) of the recording medium P, is provided at the downstream side of the cooling unit 110.

A detecting device 180, that detects toner density defects, image defects, image position defects and the like of the toner image that is fixed on the recording medium P, is provided at the downstream side of the correcting device 140.

At the detecting device 180, toner density defects, image defects, image position defects, and the like are detected by reflected light, that is illuminated onto the recording medium P from a light source and is reflected upward by the recording medium P, being detected by a detecting element such as a CCD (Charge Coupled Device) image sensor or the like.

Discharging rollers 198, that discharge the recording medium P, on whose one side an image has been formed, out to a discharging section 196 that is mounted to the side surface of the second housing 10B, are provided downstream of the detecting device 180.

On the other hand, when images are to be formed on both surfaces, the recording medium P that is sent-out from the detecting device 180 is transported to an inversion path 202 that is provided at the downstream side of the detecting device 180.

Provided at the inversion path 202 are: a forked-off path 202A that is forked-off from the transporting path 60; a sheet transporting path 202B, that transports, toward the first housing 10A, the recording medium P that is transported along the forked-off path 202A; and an inverting path 202C that turns the recording medium P, that is transported along the sheet transporting path 202B, back in the opposite direction so as to switchback-transport the recording medium P and invert the obverse/reverse thereof.

Due to this structure, the recording medium P that is switchback-transported at the inverting path 202C is transported toward the first housing 10A, and further, is fed into the transporting path 60 provided above the recording media accommodating sections 48 and is again fed to the transfer position T.

The image forming processes of the image forming device 10 are described next.

The image data, that has been subjected to image processings at the image signal processing section 13, is sent to the respective optical scanners 40. At the optical scanners 40, the respective light beams L are illuminated in accordance with the image data and expose the respective image carriers 18 that have been charged by the scorotron chargers 20, such that electrostatic latent images are formed, respectively.

As shown in FIG. 18, the electrostatic latent images that are formed on the image carriers 18 are developed by the developing devices 22, and toner images of the respective colors of the first special color (V), the second special color (W), yellow (Y), magenta (M), cyan (C) and black (K) are formed.

As shown in FIG. 19, the toner images of the respective colors, that are formed on the image carriers 18 of the respective image forming units 16V, 16W, 16Y, 16M, 16C, 16K, are successively transferred in a superposed manner onto the intermediate transfer belt 34 by the six first transfer rollers 36V, 36W, 36Y, 36M, 36C, 36K.

The toner images of the respective colors, that have been transferred onto the intermediate transfer belt 34 so as to be superposed one on another, are second-transferred, by the second transfer roller 62, onto the recording medium P that is transported-in from the recording media accommodating section 48. The recording medium P, on which the superposed toner images have been transferred, is transported by the transporting belts 70 toward the fixing unit 82 that is provided within the second housing 10B.

The toner images of the respective colors on the recording medium P are fixed to the recording medium P by heat and pressure being applied thereto by the fixing unit 82. Further, the recording medium P on which the toner images have been fixed passes through the cooling unit 110 and is cooled, and thereafter, is sent into the correcting device 140 such that curvature that has arisen at the recording medium P is corrected.

Image defects and the like of the recording medium P, whose curving has been corrected, are detected by the detecting device 180. Thereafter, the recording medium P is discharged-out to the discharging section 196 by the discharging rollers 198.

On the other hand, when an image is to be formed on the non-image surface at which an image has not been formed (i.e., if double-sided printing is to be carried out), after passing through the detecting device 180, the recording medium P is inverted at the inversion path 202, and is fed-into the transporting path 60 provided above the recording media accommodating sections 48. Toner images are formed on the reverse surface of the recording medium P by the processes described above.

Note that, in the image forming device 10 relating to the present exemplary embodiment, the parts for forming the images of the first special color and the second special color (the image forming units 16V, 16W, the optical scanners 40V, 40W, the toner cartridges 14V, 14W, the first transfer rollers 36V, 36W) are structured so as to be able to be installed in the first housing 10A as additional parts in accordance with the selection of the user. Accordingly, the image forming device 10 may be structured so as to not have parts for forming images of a first special color and a second special color, or may be structured so as have only parts for forming the image of either one color among a first special color and a second special color.

(Structure of Main Portions)

The sheet material transporting device 80 that is disposed at the upstream side of the fixing unit 82 is described next.

Figure 14:
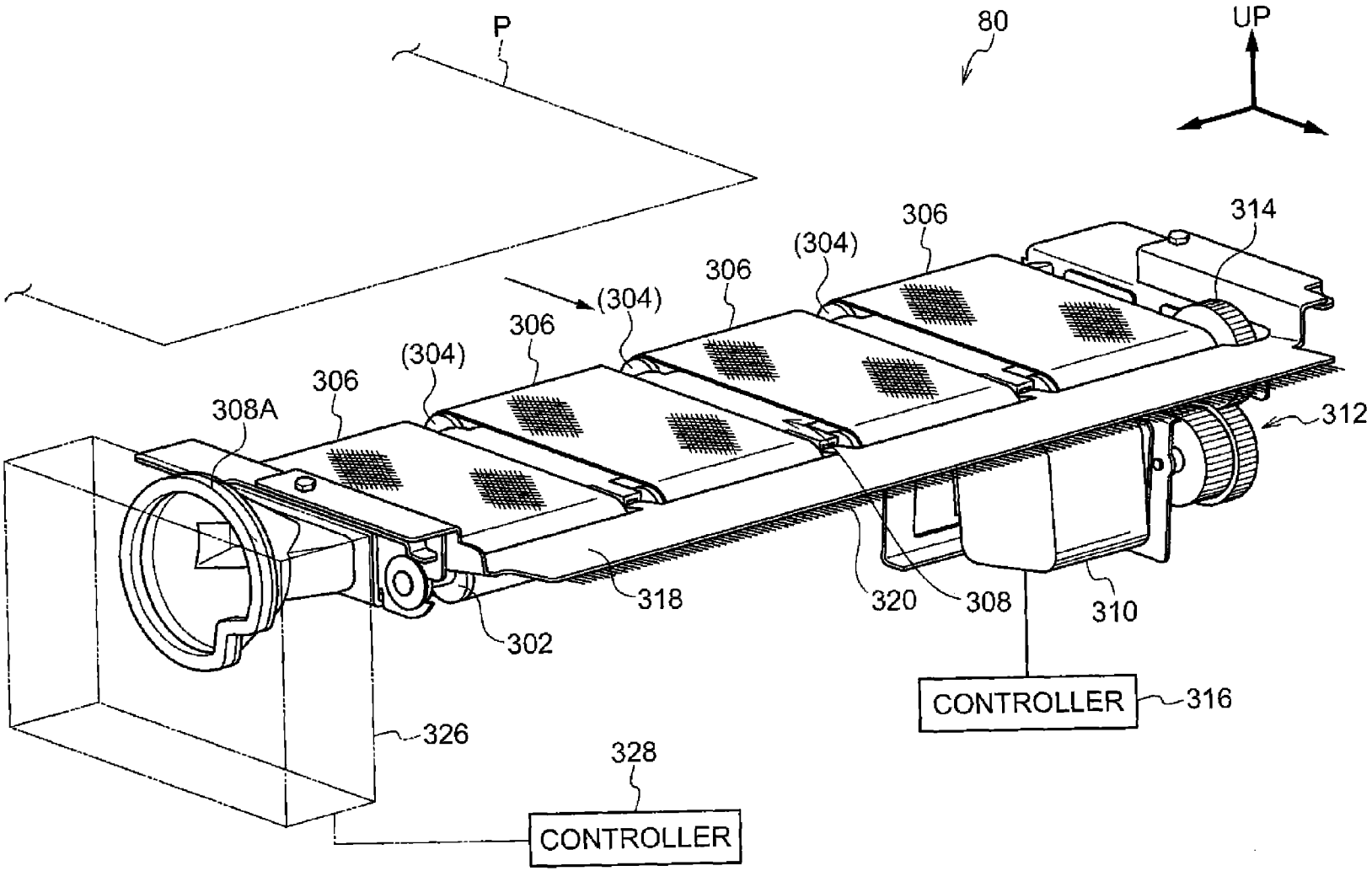
FIG. 14 is a perspective view showing the sheet material transporting device relating to the exemplary embodiment of the present invention.
Figure 17:
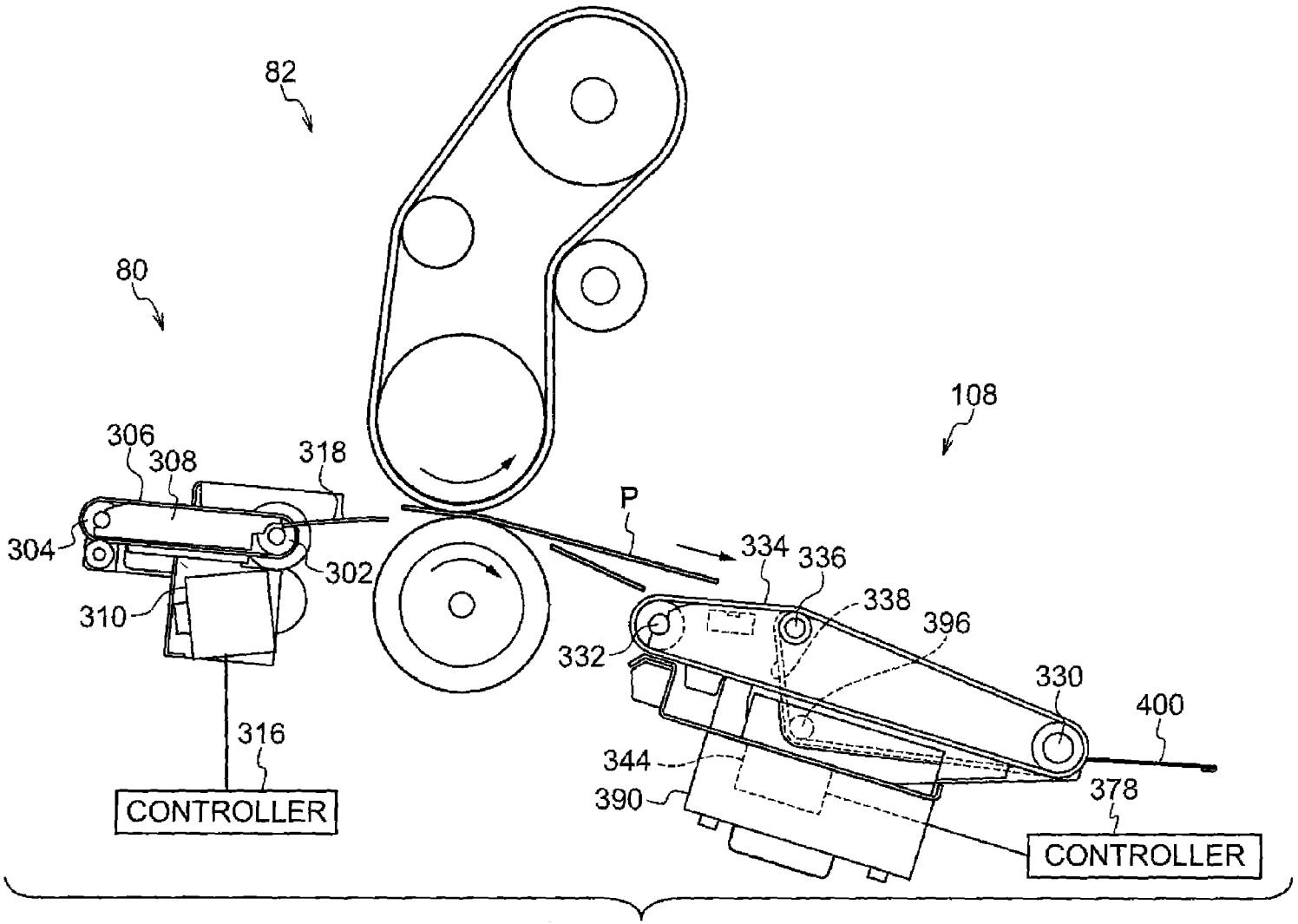
FIG. 17 is a side view showing the sheet material transporting device relating to the exemplary embodiment of the present invention.

As shown in FIG. 14 and FIG. 17, the sheet material transporting device 80 is structured to include: a drive roller 302 that serves as an example of a driving member that is driven and rotated; a driven roller 304 serving as an example of a driven member that is provided at the upstream side of the drive roller 302 and is supported so as to be rotatable; four endless belts 306 that are trained around the drive roller 302 and the driven roller 304; and a duct member 308 that is disposed at the inner peripheral surface side of the endless belts 306, and that supports the driven roller 304 at the upstream side, and whose interior is hollow. Namely, the rotating members that circulate the endless belts 306 are structured by the drive roller 302 and the driven roller 304. Due to the drive roller 302 being driven to rotate, the endless belts 306 circulate. The driven roller 304 contacts the endless belts 306 that circulate, and is slave-rotated thereby.

In detail, the driven roller 304, that supports the inner peripheral surfaces of the endless belts 306, is molded of a resin material. The outer peripheral portion of the drive roller 302, that supports the inner peripheral surfaces of the endless belts 306, is formed of a rubber material.

A motor 310, that serves as an example of a driving source and is supported at a bracket 311 that is fixed to the duct member 308, and a gear train 312, that is supported at a bracket 313 fixed to the duct member 308 and at an output shaft 310A of the motor 310, are provided at the lower side of the endless belts 306. A gear 314, to which driving force is transmitted via the gear train 312 from the output shaft 310A of the motor 310, is provided at one end portion of the drive roller 302.

As shown in FIG. 17, a controller 316, that serves as an example of a first control section that controls driving of the motor 310, is provided. The controller 316 drives the motor 310 at times of image formation when an image is formed on the recording medium P (the sheet material), and drives the motor 310 also at non image formation times (during standby) when an image is not formed on the recording medium P (the sheet material), and causes the endless belts 306 to circulate.

Further, as shown in FIG. 14, a substantially circular opening portion 308A is provided at one end of the duct member 308 whose interior is formed to be hollow. The opening portion 308A is mounted to an air suction port (not illustrated) of a fan 326 that serves as an example of a suction member that sucks air in and that is provided at the device main body.

Plural opening holes (not illustrated) are provided in the top surface of the duct member 308 that is provided at the side of the endless belts 306 that is opposite the side at which the transported recording medium P is located. When the fan 326 that is provided at the device main body is operated, air is sucked-in into the interior of the duct member 308 from the opening holes provided in the top surface of the duct member 308.

A controller 328, that serves as an example of a second control section and controls operation of the fan 326, is provided. The controller 328 causes the fan 326 to operate at times of image formation when an image is formed on the recording medium P (the sheet material), and causes the fan 326 to operate also at non image formation times (during standby) when an image is not formed on the recording medium P, such that air is sucked-in into the interior of the duct member 308 from the opening holes provided in the top surface of the duct member 308.

Figure 7B:
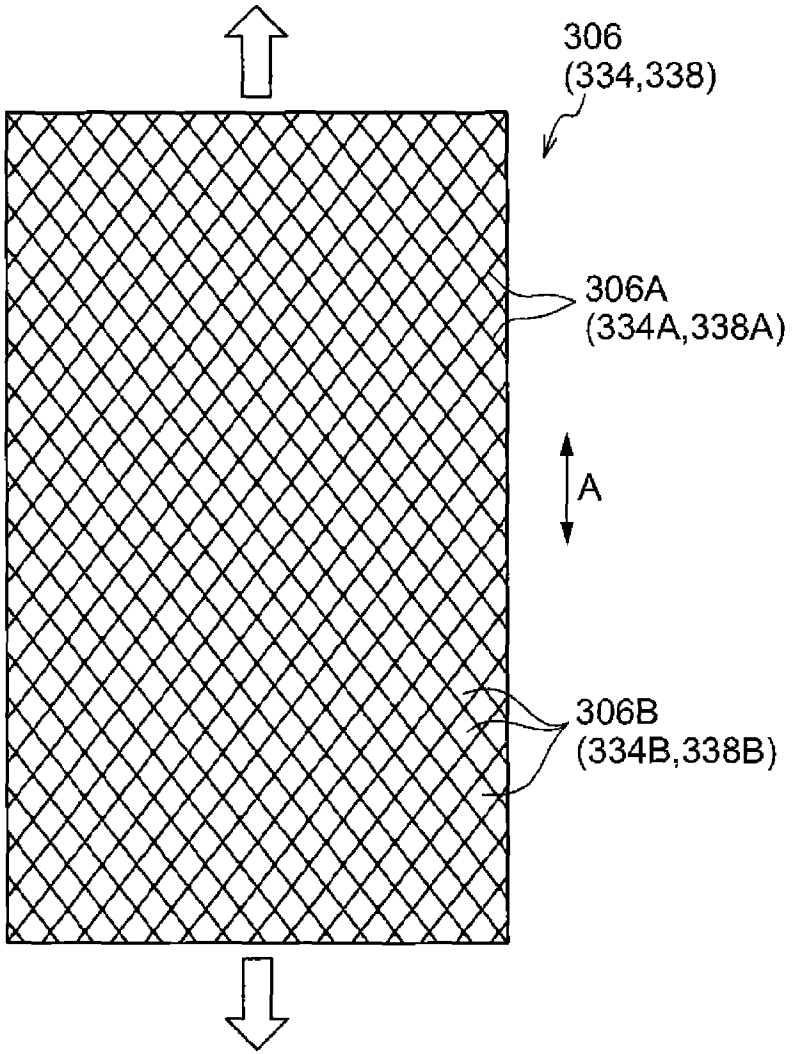
FIGS. 7A and 7B are enlarged plan views showing an endless belt that is employed in the sheet material transporting device relating to the exemplary embodiment of the present invention.
Figure 7A:
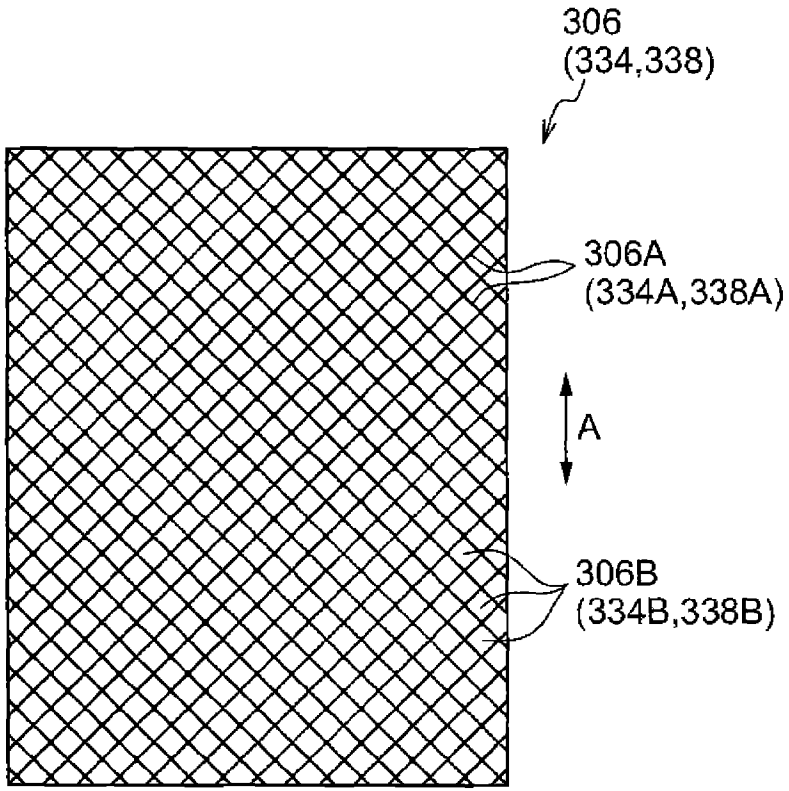

As shown in FIG. 7A, the endless belt 306 is formed by making a strip (band) material, in which fibers 306A molded of a resin material (polyester resin in the present exemplary embodiment) are woven into a mesh form, into an annular form. The directions of weaving of the fibers 306A are inclined such that the fibers 306A have line symmetry each other across the recording medium transporting direction (the direction of arrow A shown in FIG. 7A and FIG. 7B).

That is, in each of the endless belts, two weaving directions of the fibers have line symmetry across the recording medium transporting direction.

By making the directions of weaving the fibers 306A be inclined with respect to the recording medium transporting direction in this way, as shown in FIG. 7B, the endless belt 306 is made to be stretchable in the recording medium transporting direction. Further, by making the endless belt 306 be a mesh form, the suction force, that sucks the air at the outer peripheral side of the endless belt 306 into the duct member 308 from mesh-shaped holes 306B (the meshes), does not become irregular at the outer peripheral surface of the endless belt 306.

The outer peripheral surface of the endless belt 306 is subjected to a surface treatment (in the present exemplary embodiment, the material used in the surface treatment is urethane resin), and the coefficient of friction with the recording medium P that is transported is made to be higher than at the inner peripheral surface. Note that a surface treatment is carried out only on the outer peripheral surface so that the material used in the surface treatment does not adhere to the inner peripheral surface.

Further, as shown in FIG. 14 and FIG. 17, a plate-shaped guiding member 318, that guides the recording medium P transported by the endless belts 306 to the fixing unit 82, is provided at the downstream side of the endless belts 306. A charge erasing brush 320, that erases charges of the recording medium P that is being transported, is provided at the distal end portion (the downstream side end portion) of the guiding member 318.

Figure 15:
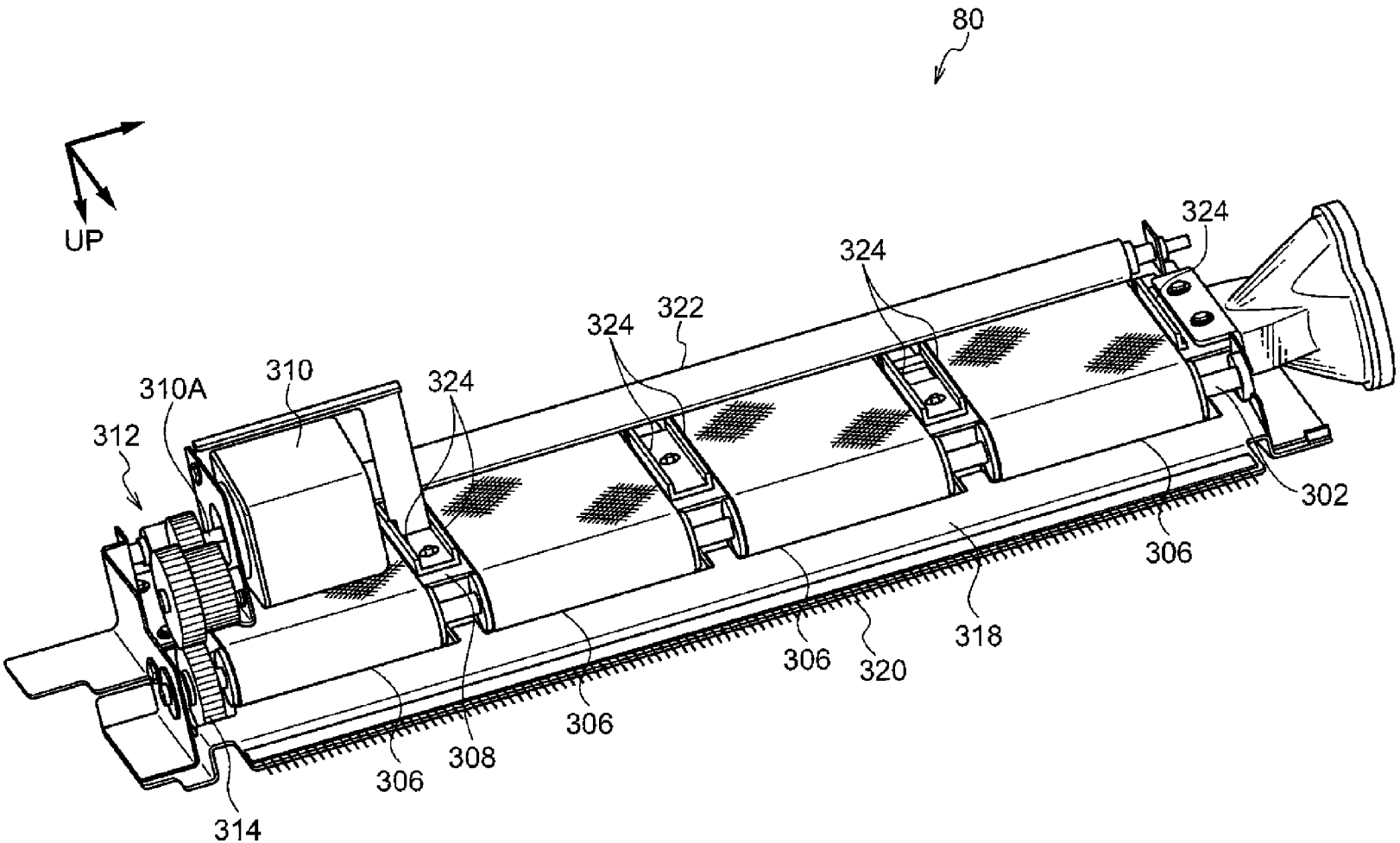
FIG. 15 is a perspective view showing the sheet material transporting device relating to the exemplary embodiment of the present invention.

As shown in FIG. 15, a cleaning roller 322, that contacts the outer peripheral surfaces of the endless belts 306 and is slave-driven thereby, is provided at the lower side of the endless belts 306. The outer peripheral surfaces of the endless belts 306 are cleaned by the cleaning roller 322.

Restricting members 324 are provided at the bottom surface of the duct member 308 (the surface side at which the recording medium P is not transported), so as to project-out from the bottom surface of the duct member 308. The restricting members 324 abut the end portions of the endless belts 306 and restrict movement of the endless belts 306 in an orthogonal direction (thrust direction) that is orthogonal to the recording medium transporting direction.

The sheet material transporting device 108 that is disposed at the downstream side of the fixing unit 82 is described next.

Figure 4:
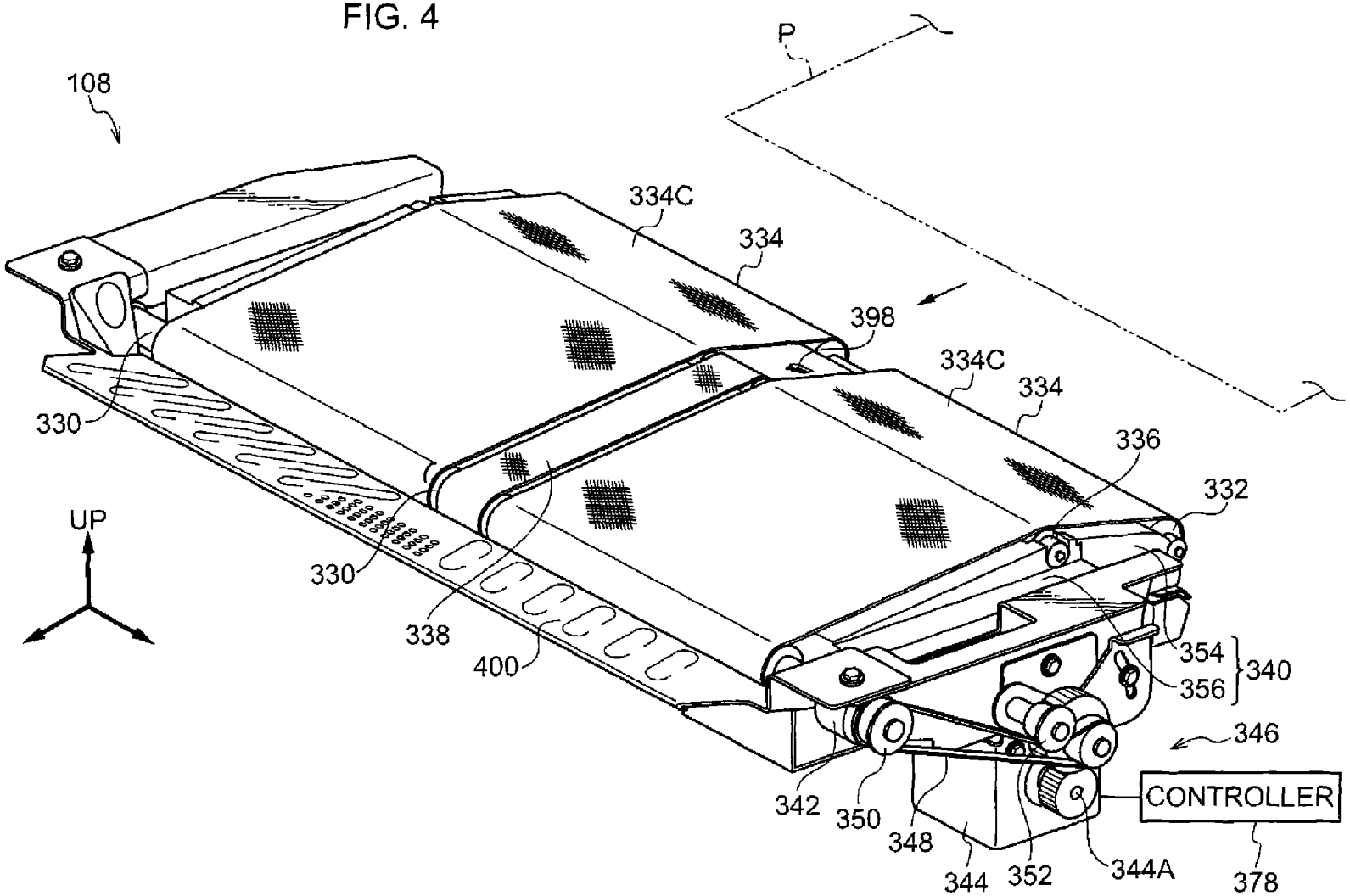
FIG. 4 is a perspective view showing the sheet material transporting device relating to the exemplary embodiment of the present invention.
Figure 5:
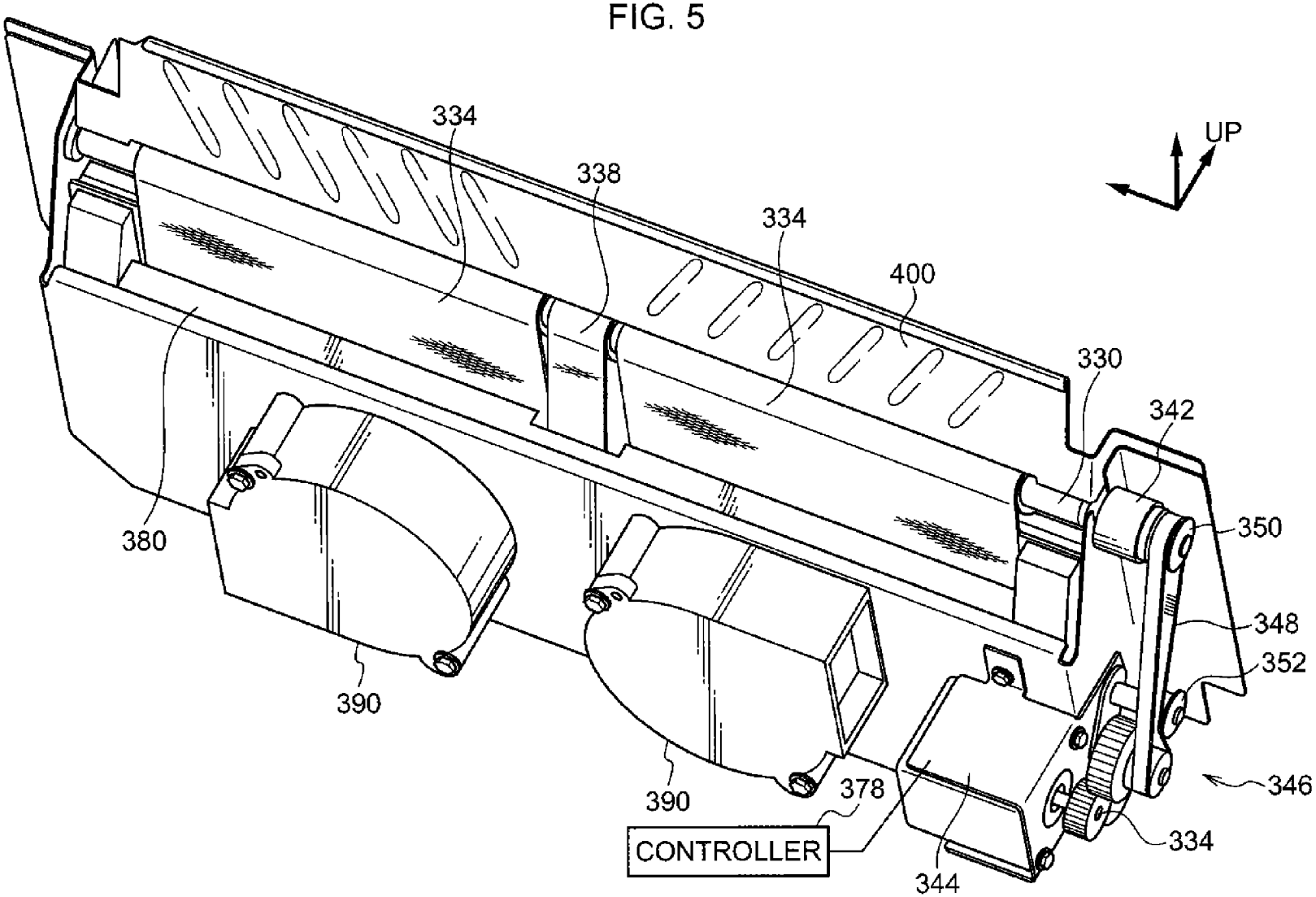
FIG. 5 is a perspective view showing the sheet material transporting device relating to the exemplary embodiment of the present invention.

As shown in FIG. 1 and FIG. 4, the sheet material transporting device 108 is structured to include: a drive roller 330 that serves as an example of a driving member that is driven and rotated; a driven roller 332 serving as an example of a driven member that is provided at the upstream side of the drive roller 330 and is supported so as to be rotatable; and two endless belts 334 that are trained around the drive roller 330 and the driven roller 332.

A driven roller 336 is provided between the drive roller 330 and the driven roller 332. The driven roller 336 contacts the inner peripheral surfaces of the endless belts 334 that circulate and is slave-rotated thereby, and raises upward the top surfaces of the endless belts 334 (the surfaces that transport the recording medium P) so as to form the inclined enter-regions 334C thereof that the recording medium P enters.

Namely, by providing the enter-regions 334C, the top surfaces of the upstream sides of the endless belts 334 are inclined with respect to the transporting direction of the recording medium P that is sent-out from the fixing unit 82, such that, as the transporting surface (attracted surface) of the recording medium P that is being transported moves downstream, the transporting surface gradually approaches the top surfaces of the endless belts 334.

An endless belt 338, that is trained around the drive roller 330 and the driven roller 336 at an opening portion 420 provided at a duct member 340 that will be described later, is provided between the two endless belts 334. The length of the transporting surface of the endless belt 338 that transports the recording medium P is shorter than the length of the transporting surfaces of the endless belts 334 that transport the recording medium P. Namely, the rotating members that cause the endless belts 334, 338 to circulate are structured by the drive roller 330 and the driven rollers 332, 336. Note that the dimension of the endless belt 338 in the transverse direction (the orthogonal direction that is orthogonal to the recording medium transporting direction) is smaller than the transverse direction dimension of the endless belts 334.

The duct member 340, that is disposed at the inner peripheral sides of the endless belts 334 and the endless belt 338 and whose interior is hollow and that serves as an example of a supporting member, is provided.

Here, as shown in FIG. 1 and FIG. 4, the driven rollers 332, 336, that support the inner peripheral surfaces of the endless belts 334, 338, are molded of a resin material. The outer peripheral portion of the drive roller 330, that supports the inner peripheral surfaces of the endless belts 334, 338, is formed of a rubber material. Further, a driving force limiting member 342 (e.g., a torque limiter) is provided at one end portion of the drive roller 330. The driving force limiting member 342 serves as an example of a driving force limiting section that limits the transmission of the driving force of a motor 344 that serves as an example of a driving source, so that the transporting speed, at which the recording medium P is transported by the sheet material transporting device 108, follows (is in accordance with) the transporting speed at which the recording medium P is transported by the fixing unit 82 (see FIG. 17). Further, a roller 350 is mounted to the driving force limiting member 342. Driving force is transmitted to the roller 350 via a gear train 346 and a driving force transfer belt 348 from an output shaft 344A of the motor 344 that is provided at the lower side of the duct member 340.

A tension imparting roller 352, that pushes the outer peripheral surface of the driving force transfer belt 348 and imparts tension to the driving force transfer belt 348, is provided. Further, the motor 344 is a stepping motor that operates synchronously with pulse voltage. Note that, in the present exemplary embodiment, the set value of the driving force limiting member 342 is 150 [mN·m] in consideration of the motor load torque and waves of the recording medium P and the like.

Further, a controller 378, that serves as an example of a control section that controls the driving of the motor 344, is provided. The controller 378 controls the driving of the motor 344 such that the set speed of the sheet material transporting device 108 that transports the recording medium P (the peripheral speed of the belts) is 0.5% faster than the set speed of the fixing unit 82 that transports the recording medium P (the peripheral speed of the roller).

The duct member 340, that is disposed at the inner peripheral surface side of the endless belts 334, 338, is structured by an upstream side duct member 354 that serves as an example of an upstream side supporting member and is disposed at the upstream side of the driven roller 336, and a downstream side duct member 356 that serves as an example of a downstream side supporting member and is disposed at the downstream side of the driven roller 336.

Figure 2:
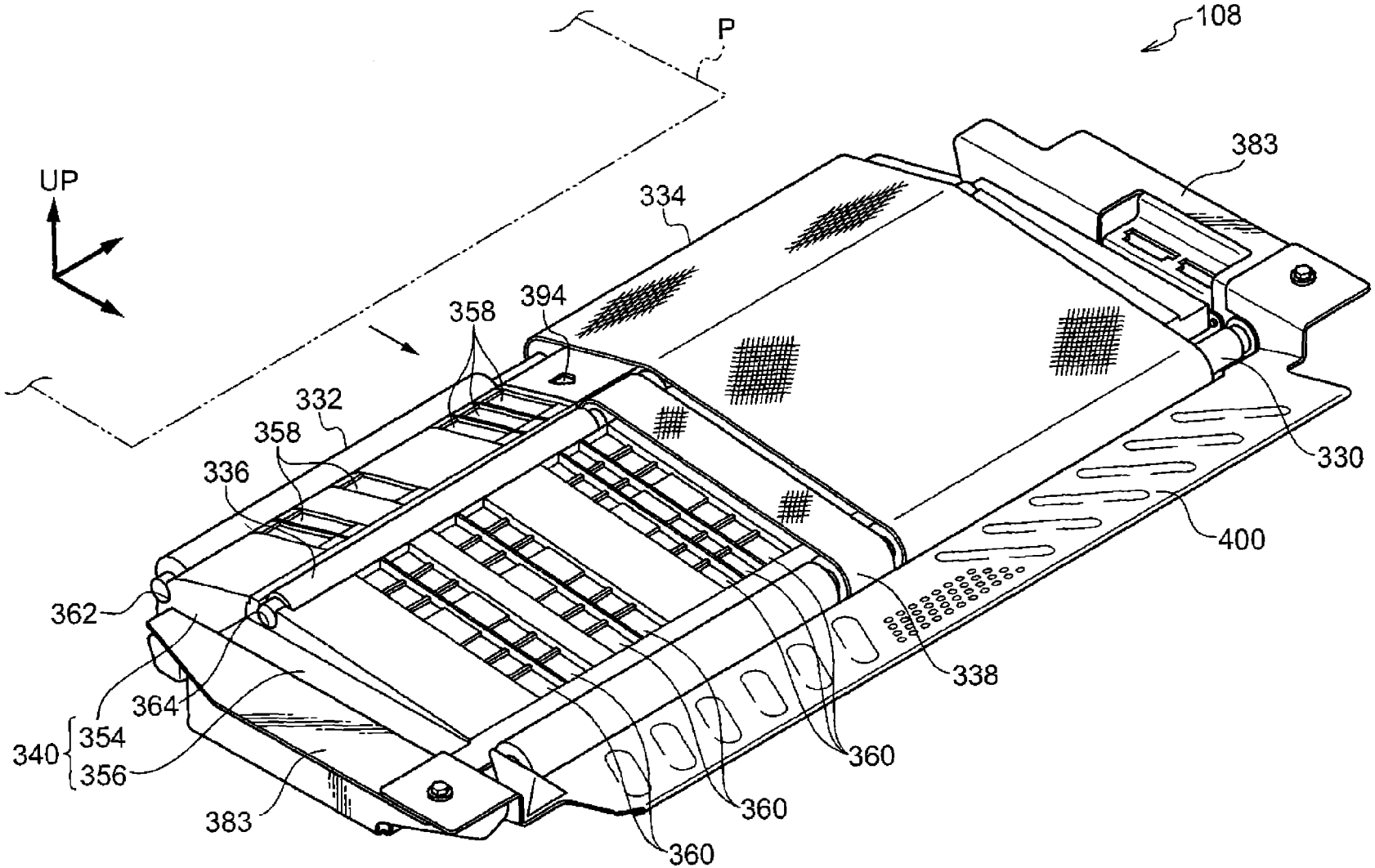
FIG. 2 is a perspective view showing the sheet material transporting device relating to the exemplary embodiment of the present invention.

FIG. 2 illustrates the sheet material transporting device 108 in a state in which one of the endless belts 334 is removed. As shown in FIG. 2, plural opening portions 358 are provided in the top surface of the upstream side duct member 354 that is disposed at the side of the endless belts 334 opposite the side at which recording medium P that is transported is located. Similarly, plural opening portions 360 are provided in the top surface of the downstream side duct member 356.

Figure 8:
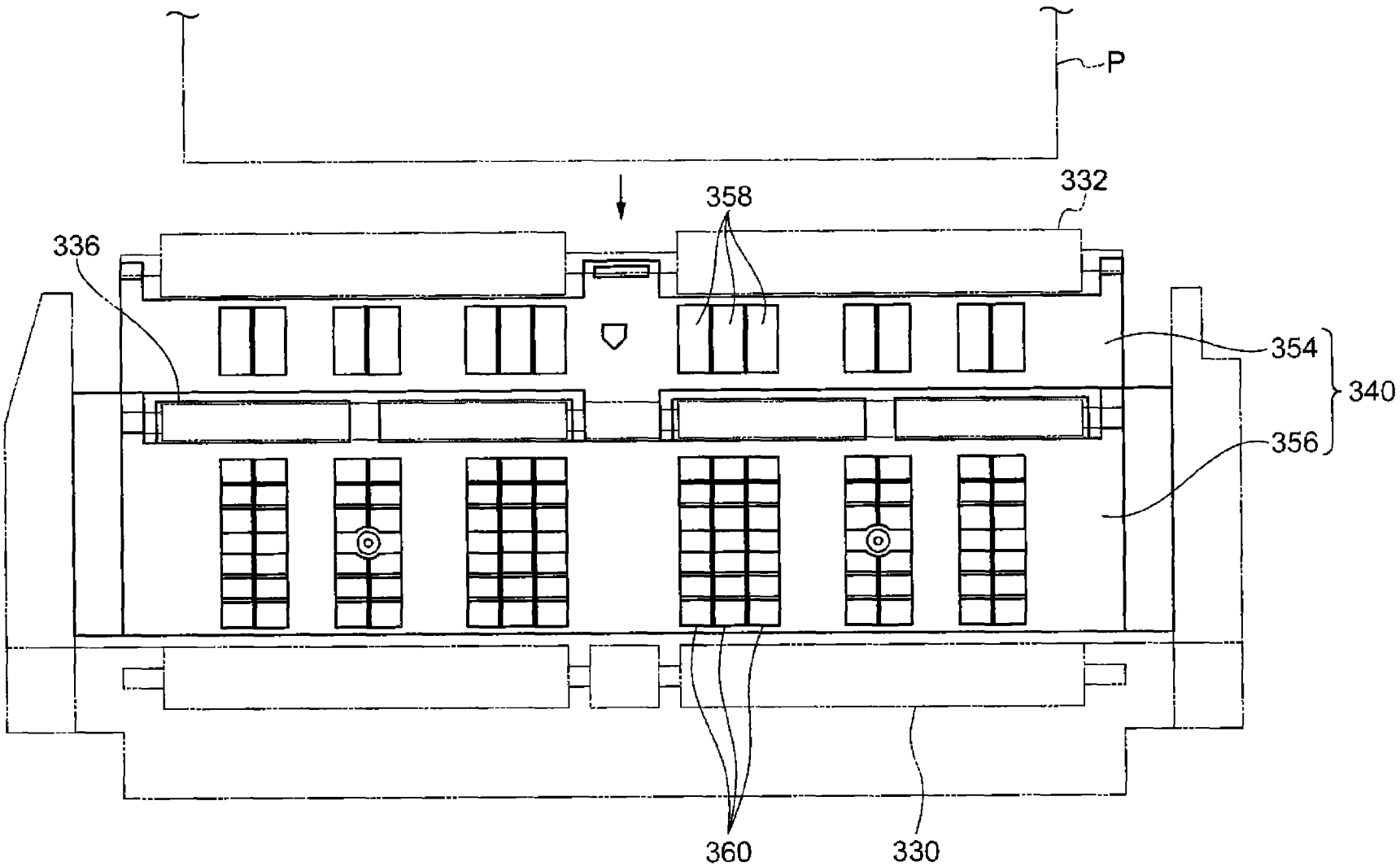
FIG. 8 is a plan view showing the sheet material transporting device relating to the exemplary embodiment of the present invention.

As shown in FIG. 8, the positions at which the opening portions 358 and the opening portions 360 are provided are determined such that, regardless of the size of the recording medium P, the recording medium P is sucked to the top surfaces of the endless belts 334, 338 without slack.

Further, as shown in FIG. 2, a concave portion 362 that supports the driven roller 332 is provided at the upstream side end portion of the upstream side duct member 354. A concave portion 364 that supports the driven roller 336 is provided in the upstream side end portion of the downstream side duct member 356.

Figure 9:
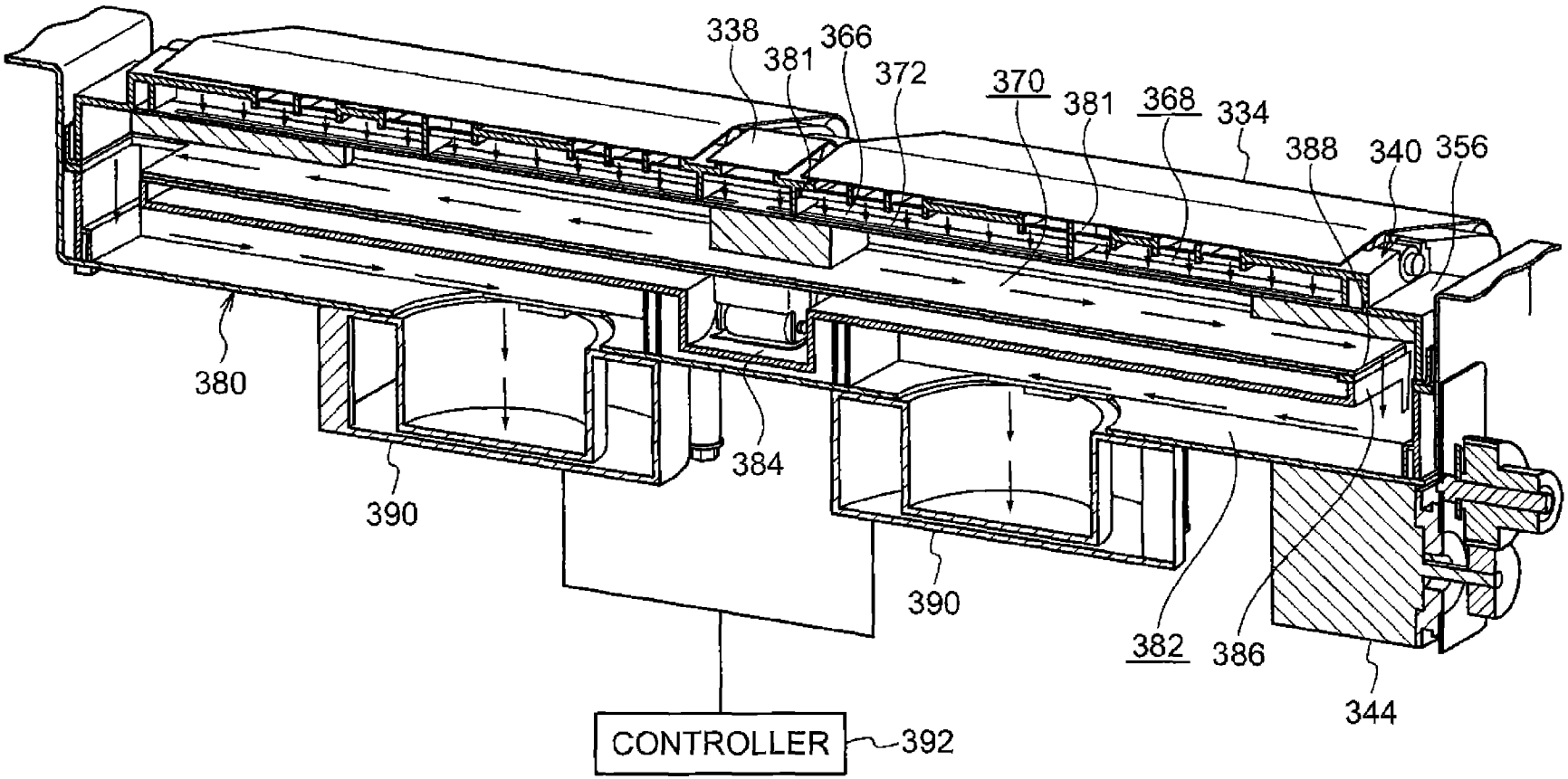
FIG. 9 is a sectional perspective view showing the sheet material transporting device relating to the exemplary embodiment of the present invention.
Figure 10:
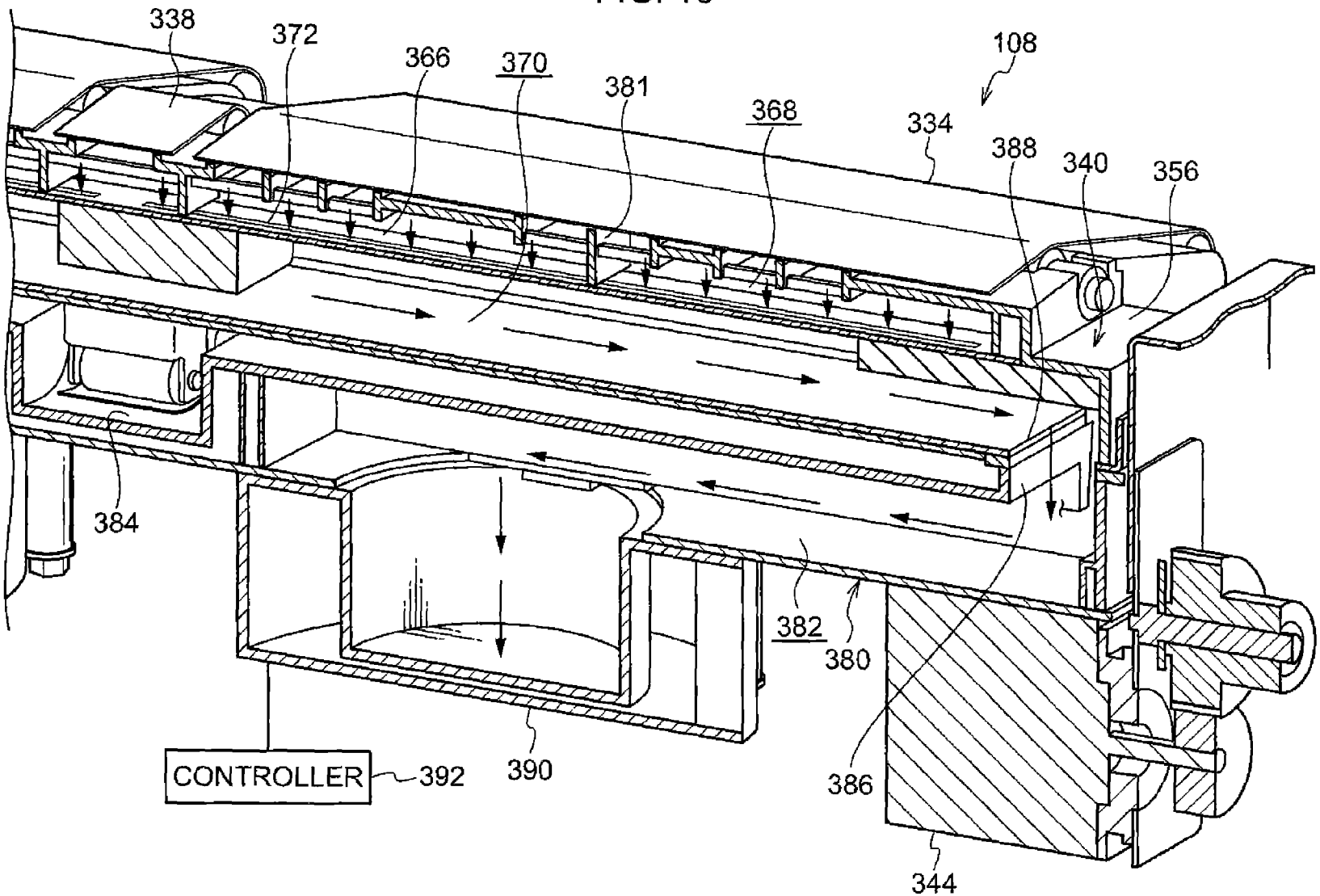
FIG. 10 is a sectional perspective view showing the sheet material transporting device relating to the exemplary embodiment of the present invention.
Figure 11:
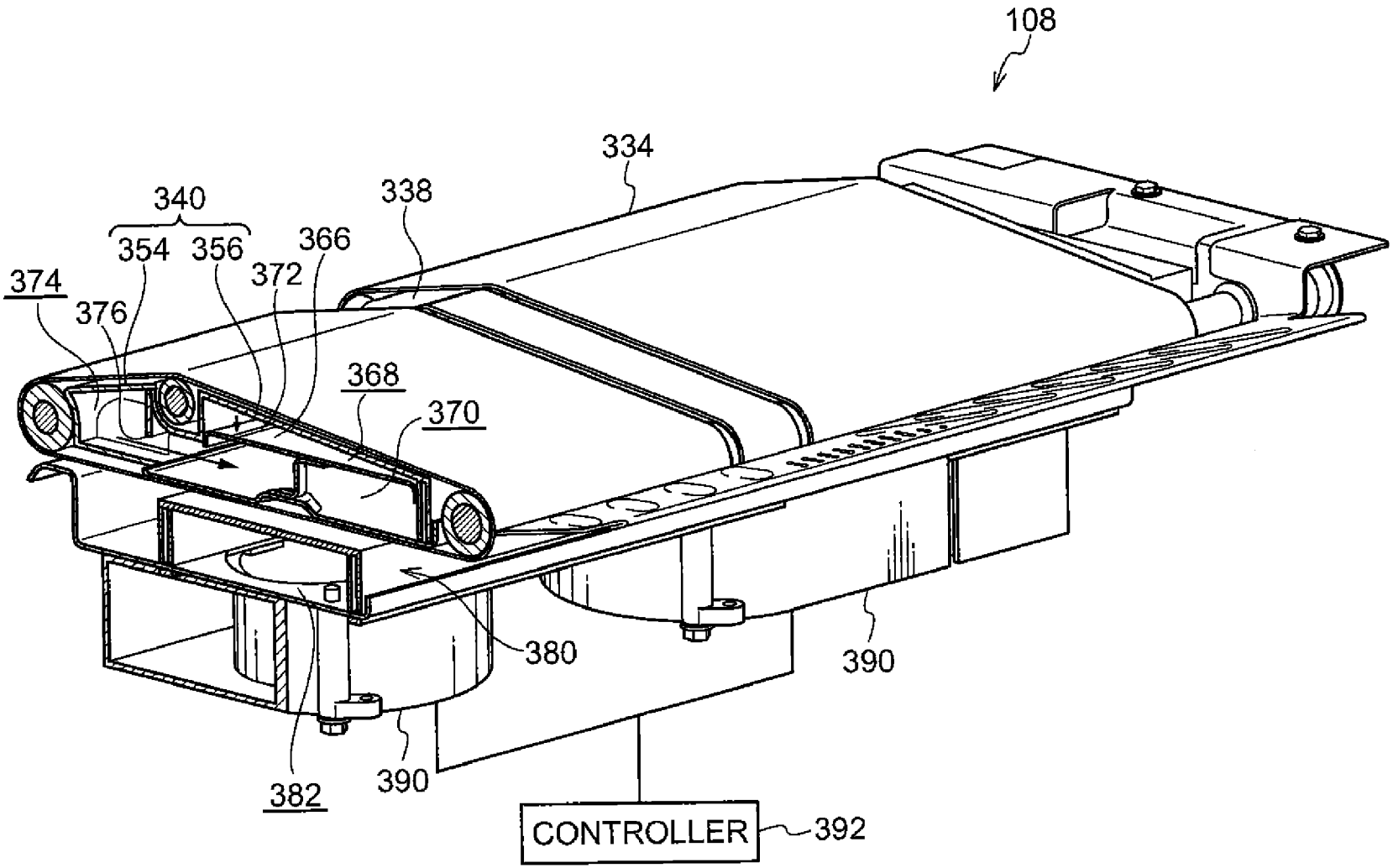
FIG. 11 is a sectional perspective view showing the sheet material transporting device relating to the exemplary embodiment of the present invention.
Figure 12:
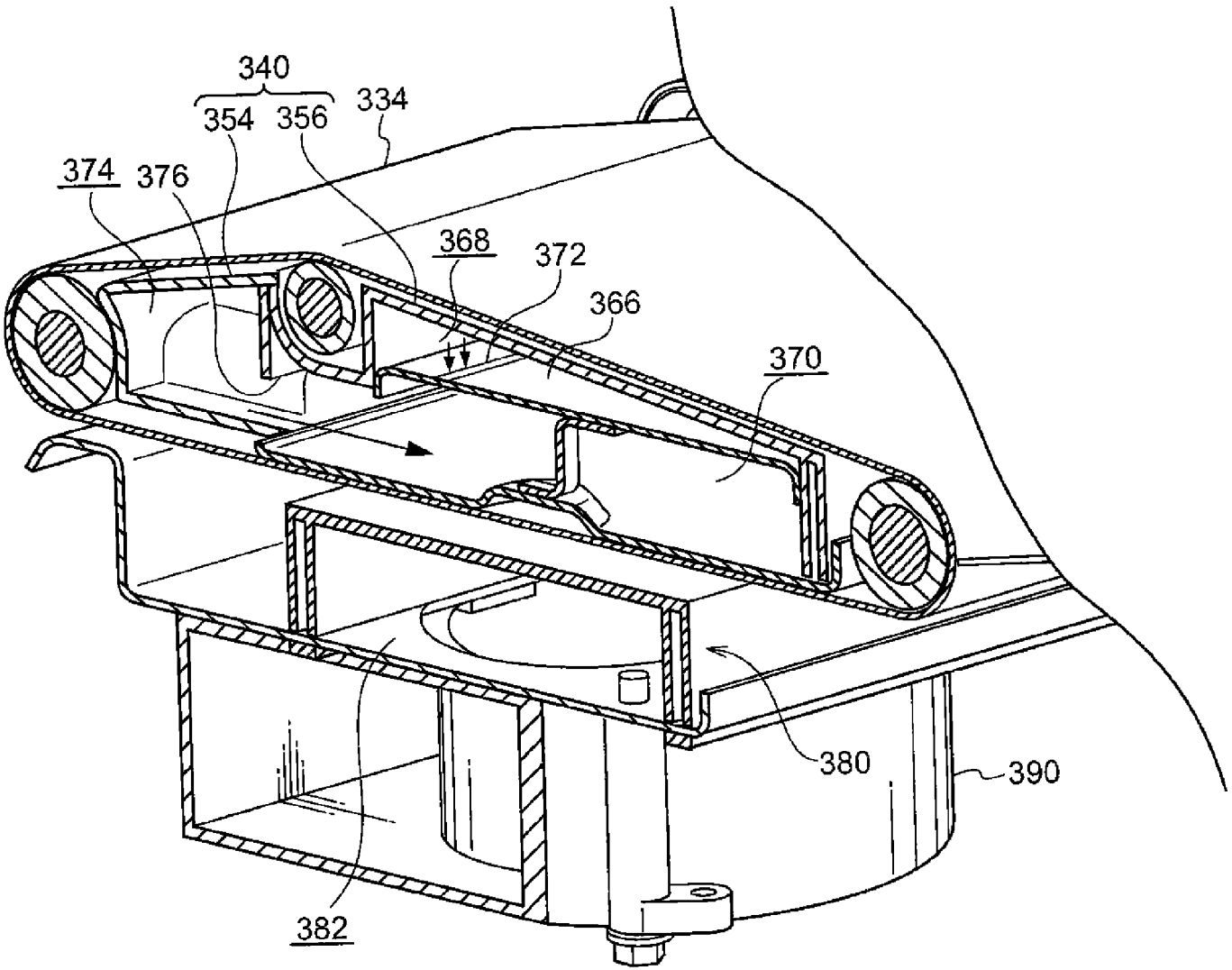
FIG. 12 is a sectional perspective view showing the sheet material transporting device relating to the exemplary embodiment of the present invention.
Figure 13:
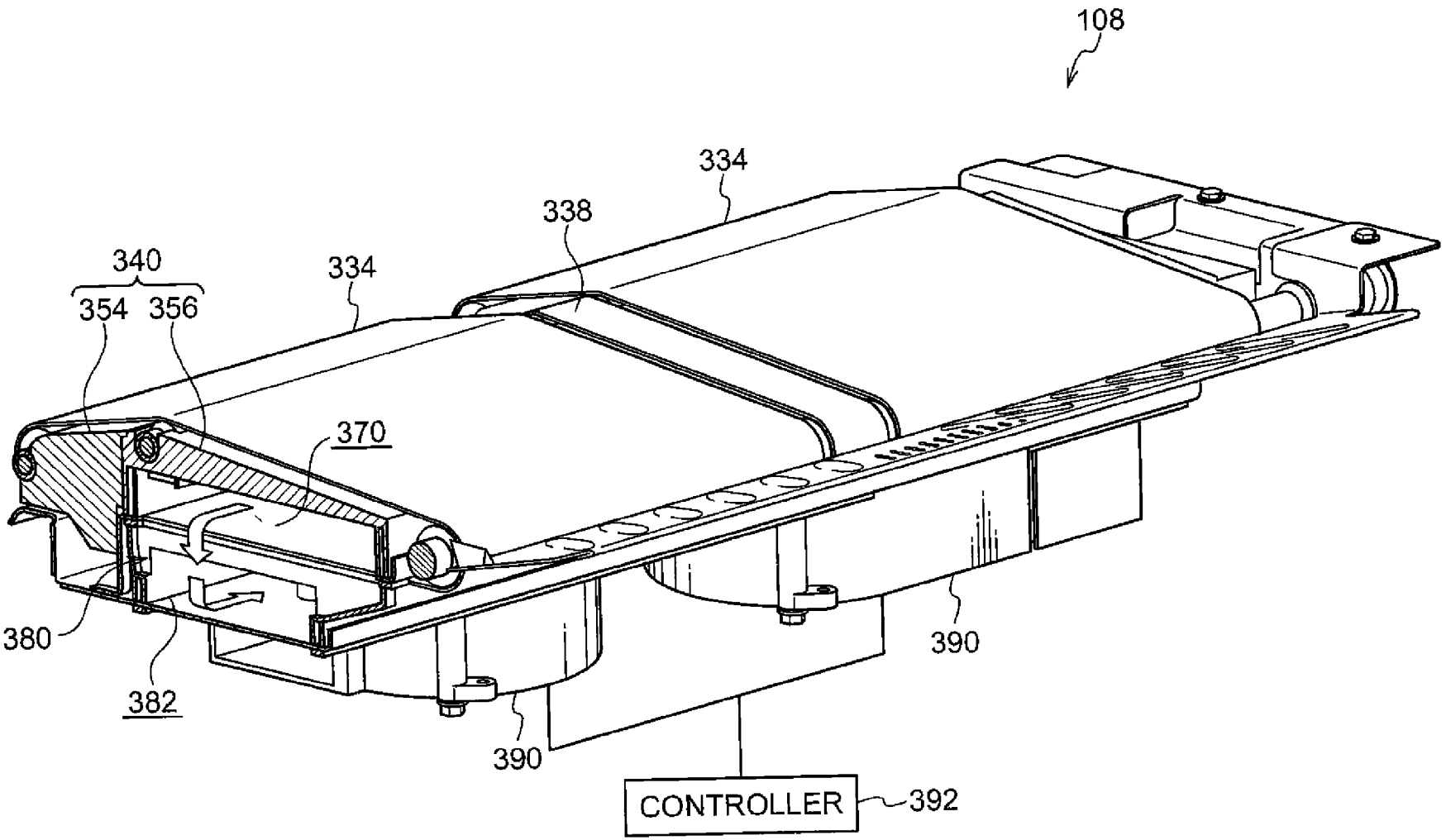
FIG. 13 is a sectional perspective view showing the sheet material transporting device relating to the exemplary embodiment of the present invention.

As shown in FIG. 11 and FIG. 12, a flow adjusting plate 366, that partitions the interior of the downstream side duct member 356 vertically, is provided within the downstream side duct member 356. A long hole 372 (slit), that connects an upper space 368 and a lower space 370 partitioned by the flow adjusting plate 366 and that extends in an orthogonal direction that is orthogonal to the recording medium transporting direction, is provided in the flow adjusting plate 366. Further, as shown in FIG. 9 and FIG. 10, the upper space 368 is divided into plural spaces by plural partitioning wall members 381.

As shown in FIG. 11 and FIG. 12, the plate-shaped flow adjusting plate 366 is provided in the downstream side duct member 356. The interior of the downstream side duct member 356 is partitioned into the upper space 368 and the lower space 370 by this flow adjusting plate 366. The long hole 372 that connects the upper space 368 and the lower space 370 is formed in the flow adjusting plate 366.

Figure 23:
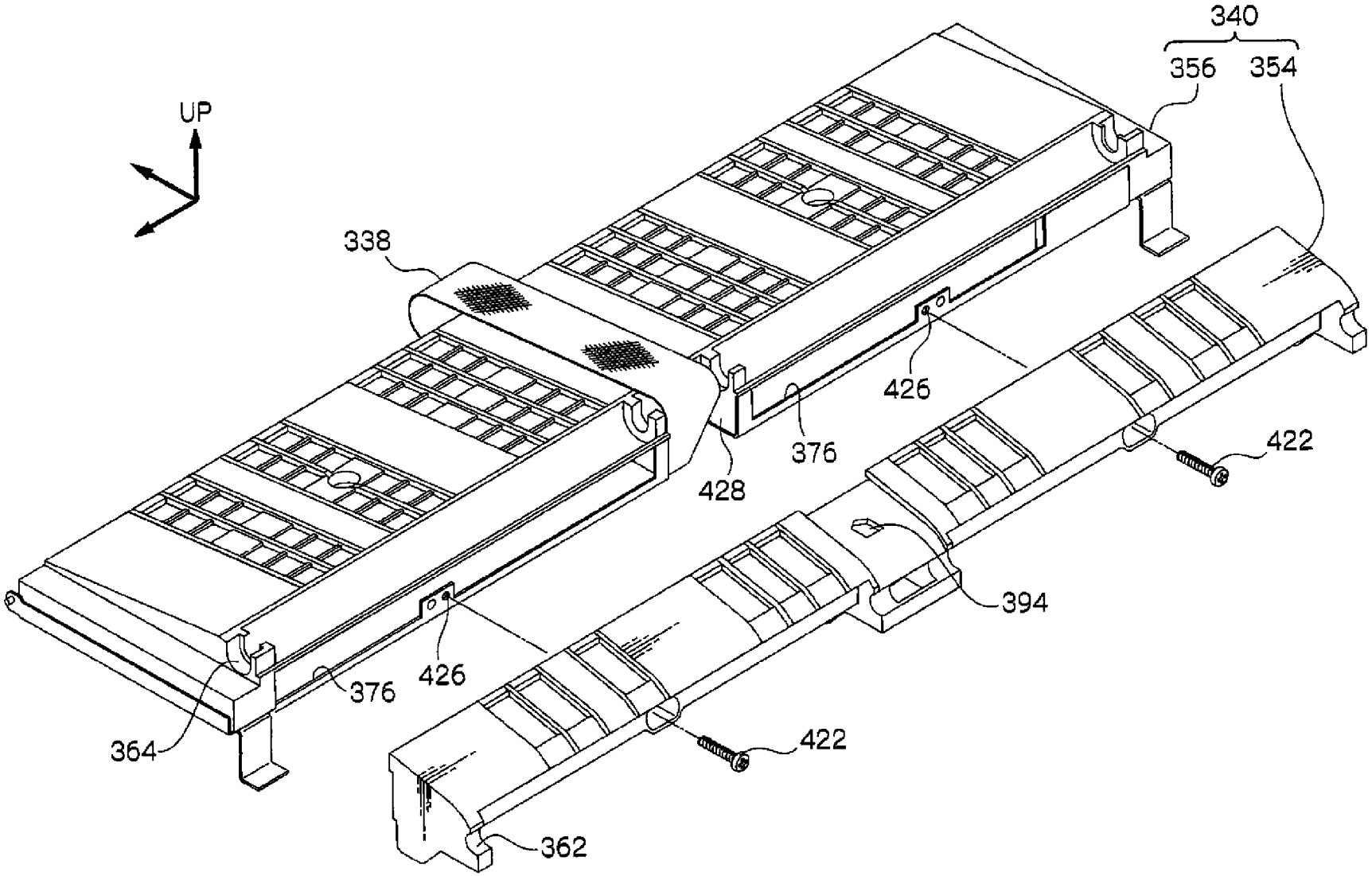
FIG. 23 is an exploded perspective view showing the duct member employed in the sheet material transporting device relating to the exemplary embodiment of the present invention.

As shown in FIG. 23, the upstream side duct member 354 and the downstream side duct member 356 can be separated. The upstream side duct member 354 is fixed to the downstream side duct member 356 by passing two screws 422 from the upstream side through mounting holes (not shown) that are formed in the upstream side duct member 354 and fastening the screws 422 into screw holes 426 that are formed in the downstream side duct member 356.

Figure 24:
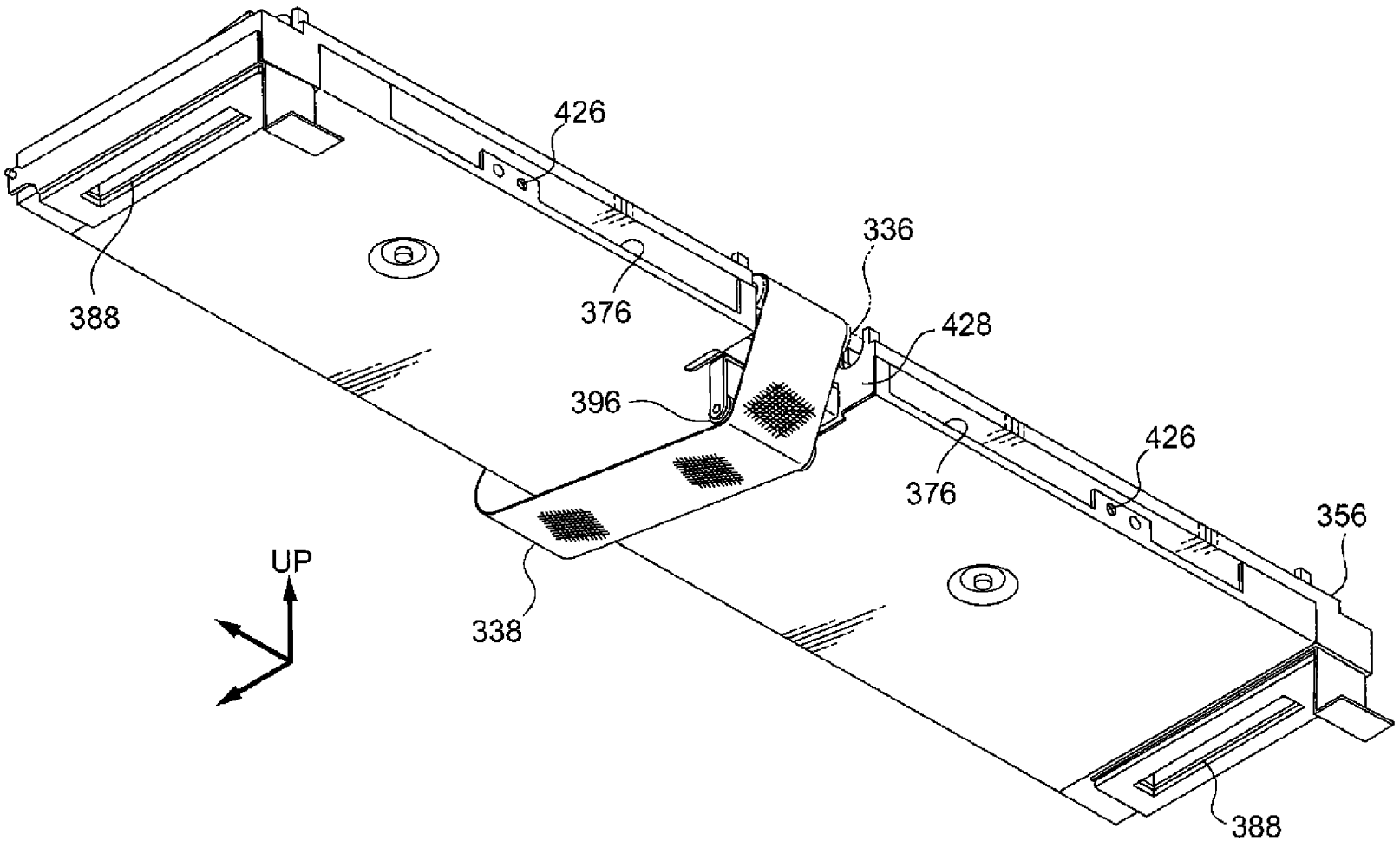
FIG. 24 is a perspective view showing a downstream side duct member employed in the sheet material transporting device relating to the exemplary embodiment of the present invention.
Figure 25:
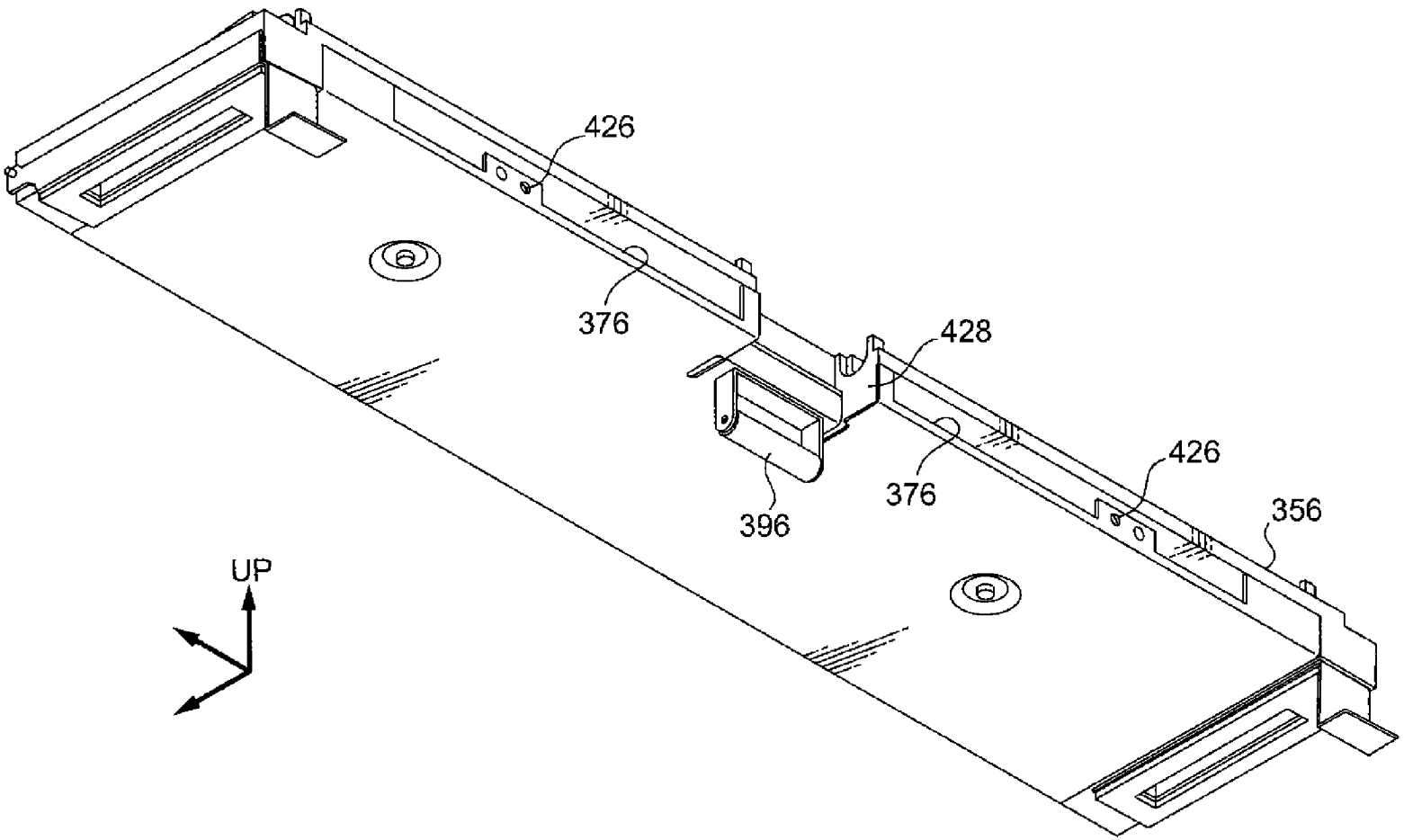
FIG. 25 is a perspective view showing the downstream side duct member employed in the sheet material transporting device relating to the exemplary embodiment of the present invention.

In detail, as shown in FIGS. 23, 24 and 25, a concave portion 428 is formed in the downstream side duct member 356 such that an upstream side end portion of the downstream side duct member 356 is concave. The endless belt 338 is trained around the driven roller 336 at this concave portion 428.

A tension imparting roller 396, that imparts tension to the endless belt 338, is provided at the bottom surface of the downstream side duct member 356 so as to project-out from the bottom surface of the downstream side duct member 356. The opening portion 420, at which the endless belt 338 is trained around the driven roller 336, is formed by that the upstream side duct member 354 is set to face this end portion of the downstream side duct member 356 and the upstream side duct member 354 is fixed by the screws 422 to the downstream side duct member 356.

Note that the peripheral direction length of the endless belt 338 is made to be longer than the peripheral direction length of the general portion (the portion at which the concave portion 428 is not formed) of the downstream side duct member 356, in order for the endless belt 338 to be able to pass through the general portion of the downstream side duct member 356 at the time of the work of installing the endless belt 338.

Further, as shown in FIG. 9, FIG. 10, FIG. 11 and FIG. 12, a supporting member 380 whose interior is hollow is provided at the lower side of the duct member 340 with the bottom surfaces of the endless belts 334 located therebetween. In detail, the interior of the supporting member 380 is hollow, and two spaces 382, that are lined-up in the orthogonal direction that is orthogonal to the recording medium transporting direction, are provided in the supporting member 380. A concave portion 384 whose upper side is open is provided between the two spaces 382 of the supporting member 380. Note that the drive roller 330 is rotatably supported at brackets 383 (see FIG. 1 and FIG. 6) that are provided at the both end portions of the supporting member 380.

Opening portions 386 at which the spaces 382 open are provided at the outer side (the axial direction end portion sides, see FIG. 6) of the top surface of the supporting member 380. Opening portions 388 at which the lower space 370 opens are provided at the bottom surface of the downstream side duct member 356 that opposes the opening portions 386 in the vertical direction. The spaces 382 and the lower space 370 are connected via the opening portions 386 and the opening portions 388.

Fans 390 (see FIG. 5), that serve as examples of suction members that suck-in air that is within the spaces 382, are provided at the bottom surface of the supporting member 380 so as to correspond to the respective spaces 382.

As shown in FIG. 9, FIG. 10, FIG. 11, FIG. 12 and FIG. 13, by operating the fans 390, the air at the top surface of the upstream side duct member 354 passes through the opening portions 358 (see FIG. 2) and enters into an upstream space 374, and further, passes through opening holes 376 and enters into the lower space 370, and passes through the opening portions 386 and the opening portions 388 and enters into the spaces 382, and is sucked-in by the fans 390 and exhausted to the exterior.

Further, the air at the top surface of the downstream side duct member 356 passes through the opening portions 360 (see FIG. 2) and enters into the upper space 368, and further, passes through the long hole 372 provided in the flow adjusting plate 366 and enters into the lower space 370, and passes through the opening portions 386 and the opening portions 388 and enters into the spaces 382, and is sucked-in by the fans 390 and exhausted to the exterior. Due thereto, the recording medium P is attracted to the outer peripheral surfaces of the endless belts 334, 338.

By adjusting the shape of the long hole 372 that is provided in the flow adjusting plate 366, the attracting force that arises at the top surface of the upstream side duct member 354 is set to be larger than the attracting force that arises at the top surface of the downstream side duct member 356.

A controller 392 that serves as an example of a control section that controls the amount of air of the fans 390 is provided. As shown in FIG. 16, when the recording medium P is a sheet, the controller 392 makes the suction force of the fans 390 constant regardless of the basis weight of the sheet. Or, if the basis weight of the sheet is small, the controller 392 makes the suction force (amount of air) of the fans 390 strong as compared with when the basis weight of the sheet is large. Note that, the greater the numerical value of the amount of air shown in FIG. 16, the stronger the suction force (amount of air).

Further, the controller 392 makes the suction force of the fans 390 constant regardless of whether the recording medium P is ordinary paper or coated paper. Or, when the recording medium P is ordinary paper, the controller 392 makes the suction force of the fans 390 strong as compared with when the recording medium P is coated paper.

As shown in FIG. 7A, the endless belts 334, 338 are respectively formed by making a strip (band) material, in which fibers 334A, 338A molded of a resin material (polyester resin in the present exemplary embodiment) are woven into a mesh form, into an annular form.

The directions of weaving of the fibers 334A, 338A of the endless belts 334, 338 are inclined so that the fibers 334A, 338A have line symmetry across the recording medium transporting direction (the direction of arrow A shown in FIG. 7A and FIG. 7B). That is, in each of the endless belts, two weaving directions of the fibers have line symmetry across the recording medium transporting direction.

By making the directions of weaving the fibers 334A, 338A be inclined with respect to the recording medium transporting direction in this way, as shown in FIG. 7B, the endless belts 334, 338 are made to be stretchable in the recording medium transporting direction. Further, by making the endless belts 334, 338 be a mesh form, the suction force, that sucks the air at the outer peripheral side of the endless belts 334, 338 into the duct member 340 from mesh-shaped holes 334B, 338B (the meshes) by operating the fans 390, does not become irregular at the outer peripheral surfaces of the endless belts 334, 338.

The outer peripheral surfaces of the endless belts 334, 338 are subjected to a surface treatment (in the present exemplary embodiment, the material used in the surface treatment is urethane resin), and the coefficients of friction with the recording medium P that is transported are increased. Note that a surface treatment is carried out only on the outer peripheral surfaces so that the material used in the surface treatment does not adhere to the inner peripheral surfaces.

Figure 6:
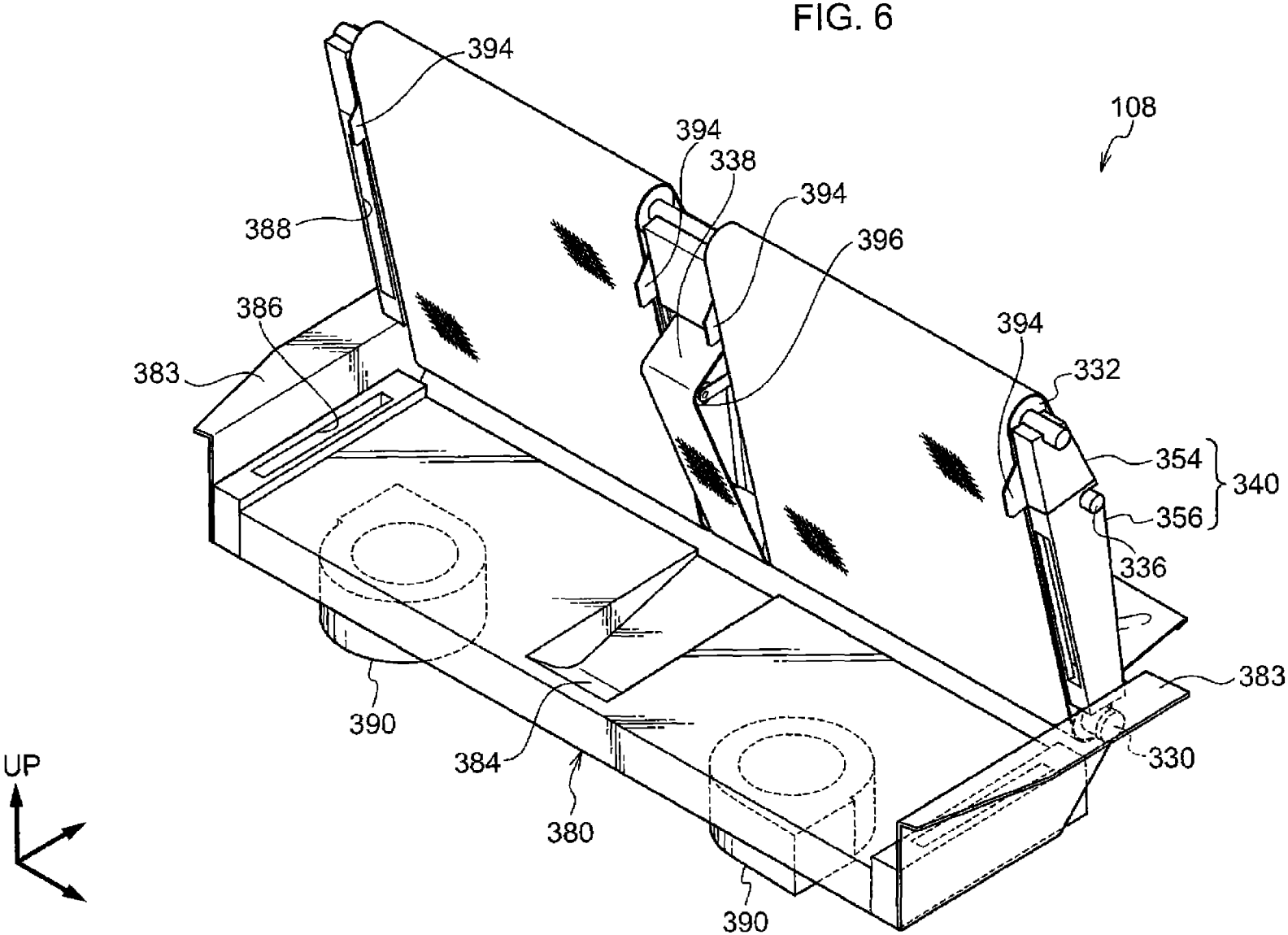
FIG. 6 is a perspective view showing the sheet material transporting device relating to the exemplary embodiment of the present invention.

FIG. 6 illustrates the sheet material transporting device 108 in a state in which the duct member 340 has been rotated around the drive roller 330. As shown in FIG. 6, restricting members 394 are provided so as to project-out at the bottom surface of the upstream side duct member 354 (the surface side at which the recording medium P is not transported). The restricting members 394 abut the end portions of the endless belts 334 and restrict movement of the endless belts 334 in an orthogonal direction (thrust direction) that is orthogonal to the recording medium transporting direction.

Figure 3:
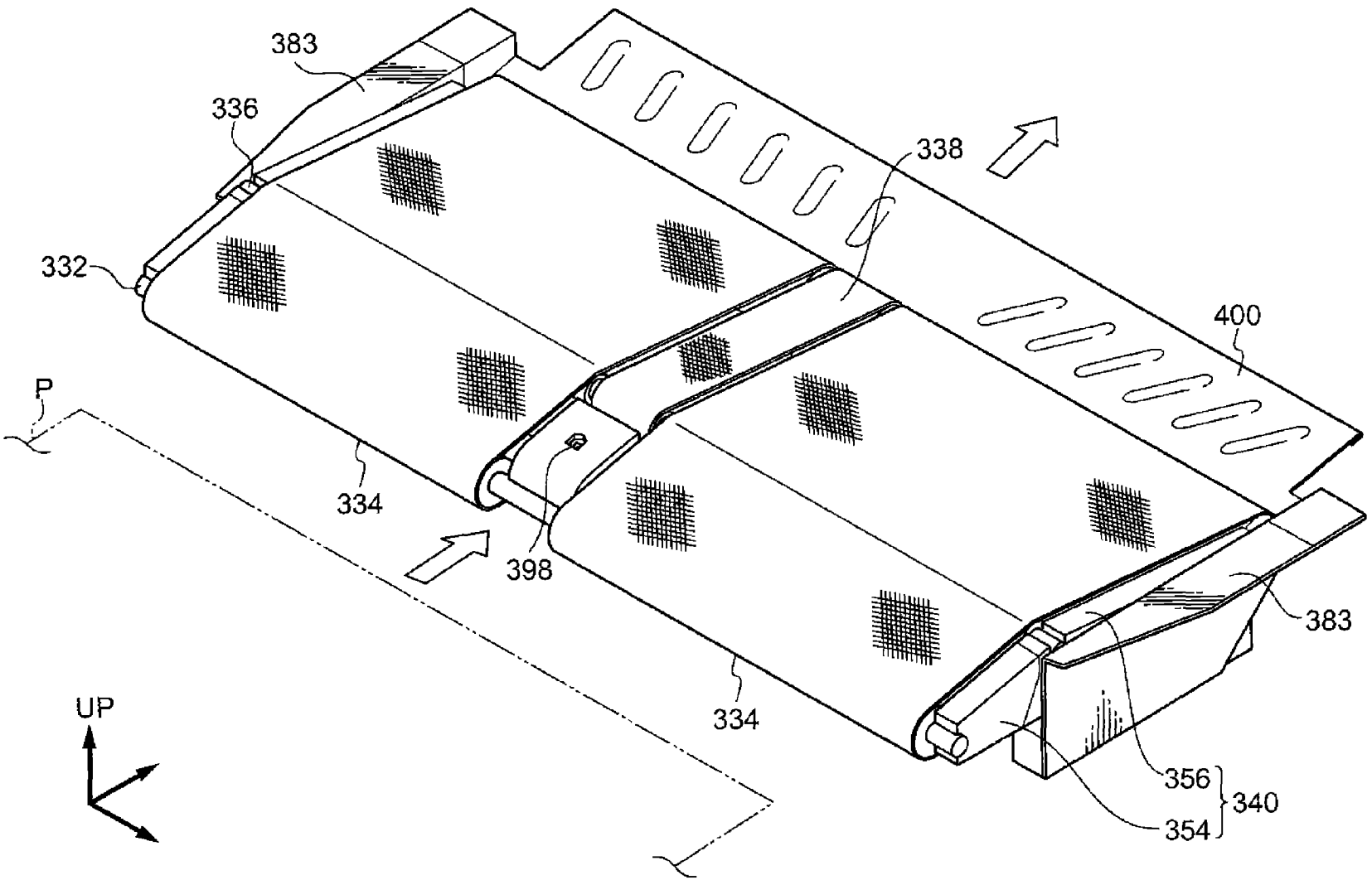
FIG. 3 is a perspective view showing the sheet material transporting device relating to the exemplary embodiment of the present invention.

Further, as shown in FIG. 1 and FIG. 3, a sensing member 398, that senses the recording medium P that is transported, is provided on the top surface of the upstream side duct member 354 at the upstream side of the endless belt 338 (between the driven roller 336 and the driven roller 332), between the two endless belts 334.

A plate-shaped guiding member 400, that guides the recording medium P transported by the endless belts 334, 338 to the cooling unit (see FIG. 19), is provided at the downstream side of the endless belts 334, 338.

(Operation)

As shown in FIG. 17 and FIG. 19, the toner images of the respective colors, that have been transferred in a superposed manner onto the intermediate transfer belt 34, are second transferred by the second transfer roller 62 onto the recording medium P that is transported. The recording medium P on which the toner images have been transferred is transported by the transporting belts 70 and sent to the sheet material transporting device 80 that is disposed at the upstream side of the fixing unit 82.

As shown in FIG. 14 and FIG. 17, the drive roller 302 is driven to rotate by the controller 316 of the sheet material transporting device 80 driving the motor 310. Due to the drive roller 302 being driven to rotate, the endless belts 306 are circulated, and the driven roller 304 contacts the endless belts 306 that are circulating and is slave-rotated thereby.

Further, the controller 328 operates the fan 326. The fan 326 sucks-out, to the exterior, the air within the duct member 308, and air is sucked-in into the duct member 308 from the plural opening holes that are provided in the top surface of the duct member 308. When air is sucked-in into the duct member 308 from the plural opening holes, the air at the outer peripheral side of the endless belts 306 is sucked-in into the duct member 308 from the mesh-shaped holes 306B of the endless belts 306, and the recording medium P, that has been sent-in from the transporting belts 70, is transported while being attracted to the endless belts 306 that circulate.

Due to the plate-shaped guiding member 318, the recording medium P, that is transported while being attracted to the endless belts 306 that circulate, contacts the charge erasing brush 320 and thereafter is guided toward the fixing unit 82.

The fixing unit 82 fixes the toner images, that have been transferred onto the surface of the recording medium P, on the recording medium P by heat and pressure. Thereafter, the fixing unit 82 transports the recording medium P toward the sheet material transporting device 108.

As shown in FIG. 4 and FIG. 17, the drive roller 330 is driven to rotate due to the controller 378 of the sheet material transporting device 108 driving the motor 344. Due to the drive roller 330 being driven to rotate, the endless belts 334, 338 circulate, and the driven rollers 332, 336 contact the endless belts 334, 338 that circulate and are slave-rotated thereby.

Further, as shown in FIG. 9, the controller 392 operates the fans 390, and the fans 390 suck the air, that is within the duct member 340, to the exterior through the spaces 382. Due thereto, air is sucked-in into the duct member 340 from the opening portions 358, 360 (see FIG. 2) that are provided in the top surface of the duct member 340.

In detail, as shown in FIG. 9, FIG. 10, FIG. 11, FIG. 12 and FIG. 13, due to the fans 390 being operated, the air at the top surface of the upstream side duct member 354 passes through the opening portions 358 (see FIG. 2) and enters into the upstream space 374, and further, passes through the opening holes 376 and enters into the lower space 370, and passes through the opening portions 386 and the opening portions 388 and enters into the spaces 382, and is sucked-in by the fans 390 and exhausted to the exterior.

Further, the air at the top surface of the downstream side duct member 356 passes through the opening portions 360 (see FIG. 2) and enters into the upper space 368, and further, passes through the long hole 372 provided in the flow adjusting plate 366 and enters into the lower space 370, and passes through the opening portions 386 and the opening portions 388 and enters the spaces 382, and is sucked-in by the fans 390 and discharged to the exterior.

When air is sucked-in into the duct member 340 from the opening portions 358, 360 (see FIG. 2), air at the outer peripheral side of the endless belts is sucked-in into the duct member 308 from the mesh-shaped holes 334B, 338B of the endless belts 334, 338. Due thereto, the recording medium P that is transported-in is attracted to the outer peripheral surfaces of the endless belts 334, 338.

As the transported surface of the recording medium P, that is sent-out by the fixing unit 82, moves downstream, the transported surface gradually approaches the top surfaces of the endless belts 334. The recording medium P is attracted to the endless belts 334 that are circulating, by the attracting force that arises at the top surface of the upstream side duct member 354. Then, the sensing member 398 senses the recording medium P that is transported, and the recording medium P is transported while being attracted to the mesh-like endless belts 334, 338.

The work of replacing the endless belt 334 is described next.

Figure 20:
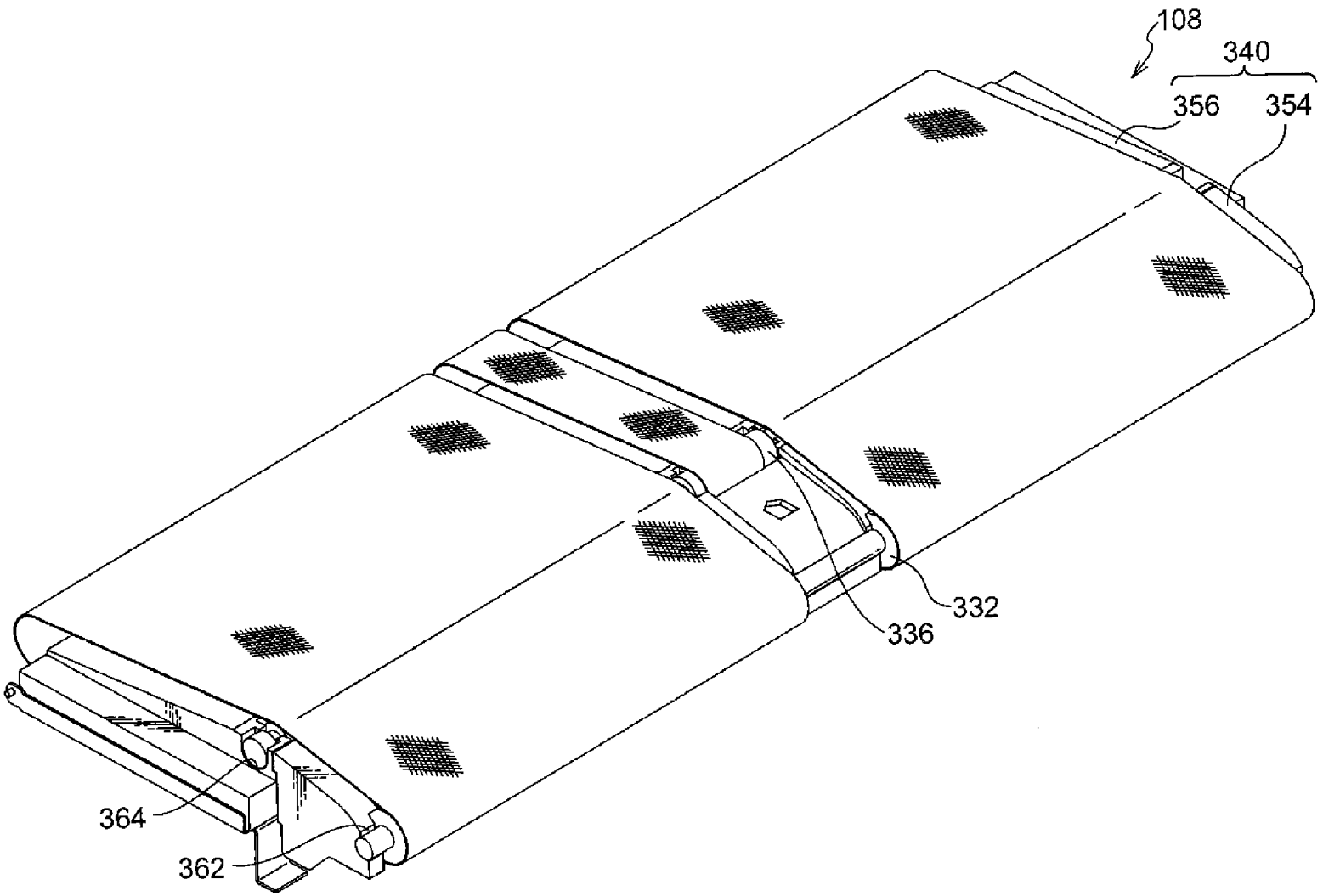
FIG. 20 is a perspective view showing a duct member and endless belts and the like that are employed in the sheet material transporting device relating to the exemplary embodiment of the present invention.
Figure 21:
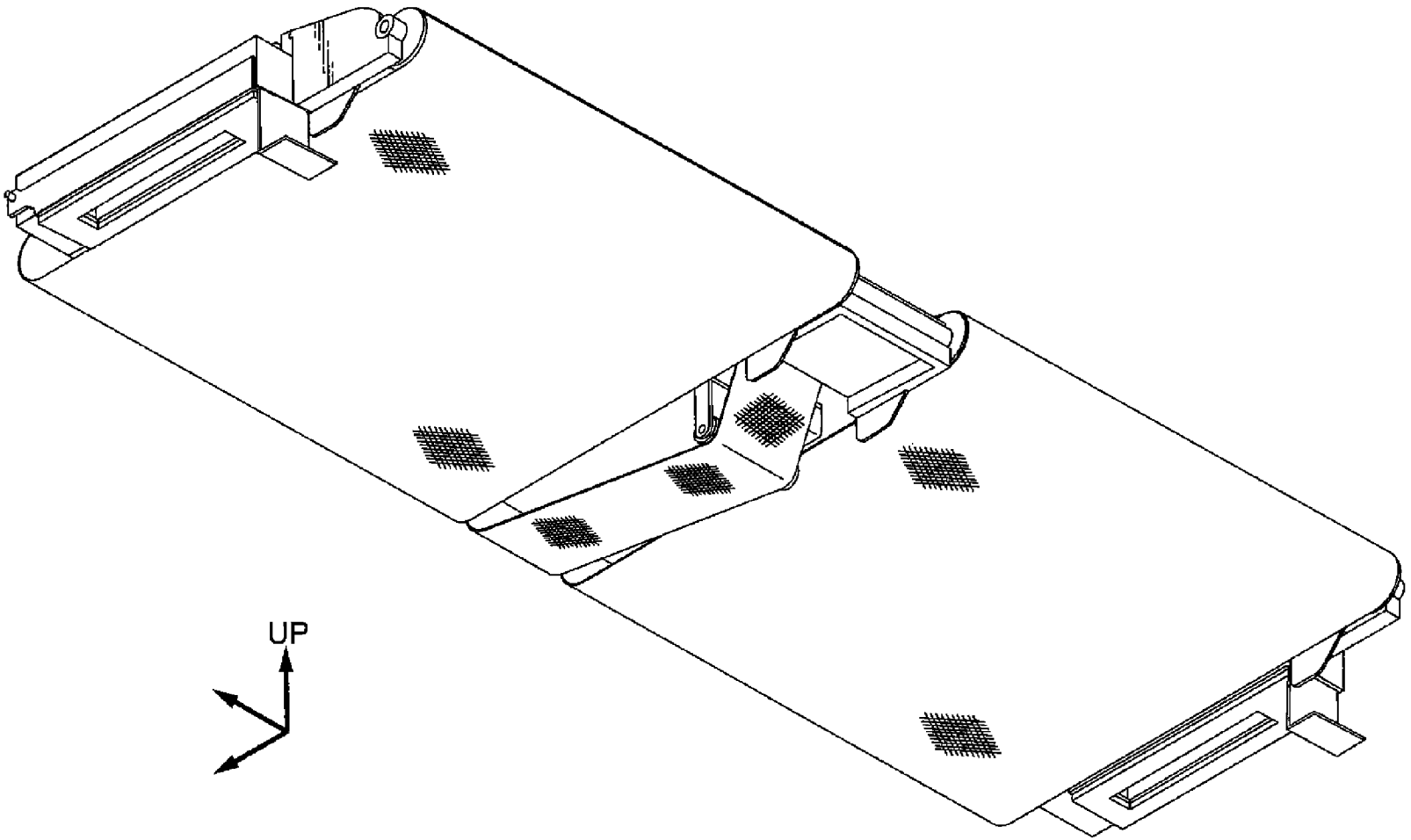
FIG. 21 is a perspective view showing the duct member and the endless belts and the like that are employed in the sheet material transporting device relating to the exemplary embodiment of the present invention.

First, as shown in FIG. 20 and FIG. 21, the both end portions of the drive roller 330 (see FIG. 1) are removed from the brackets 383 that are provided at the both end portions of the supporting member 380. In the state in which the endless belts 334, 338 are trained around the duct member 340, the drive roller 330 that has been removed from the brackets 383 is pulled-out from the duct member 340.

Figure 22:
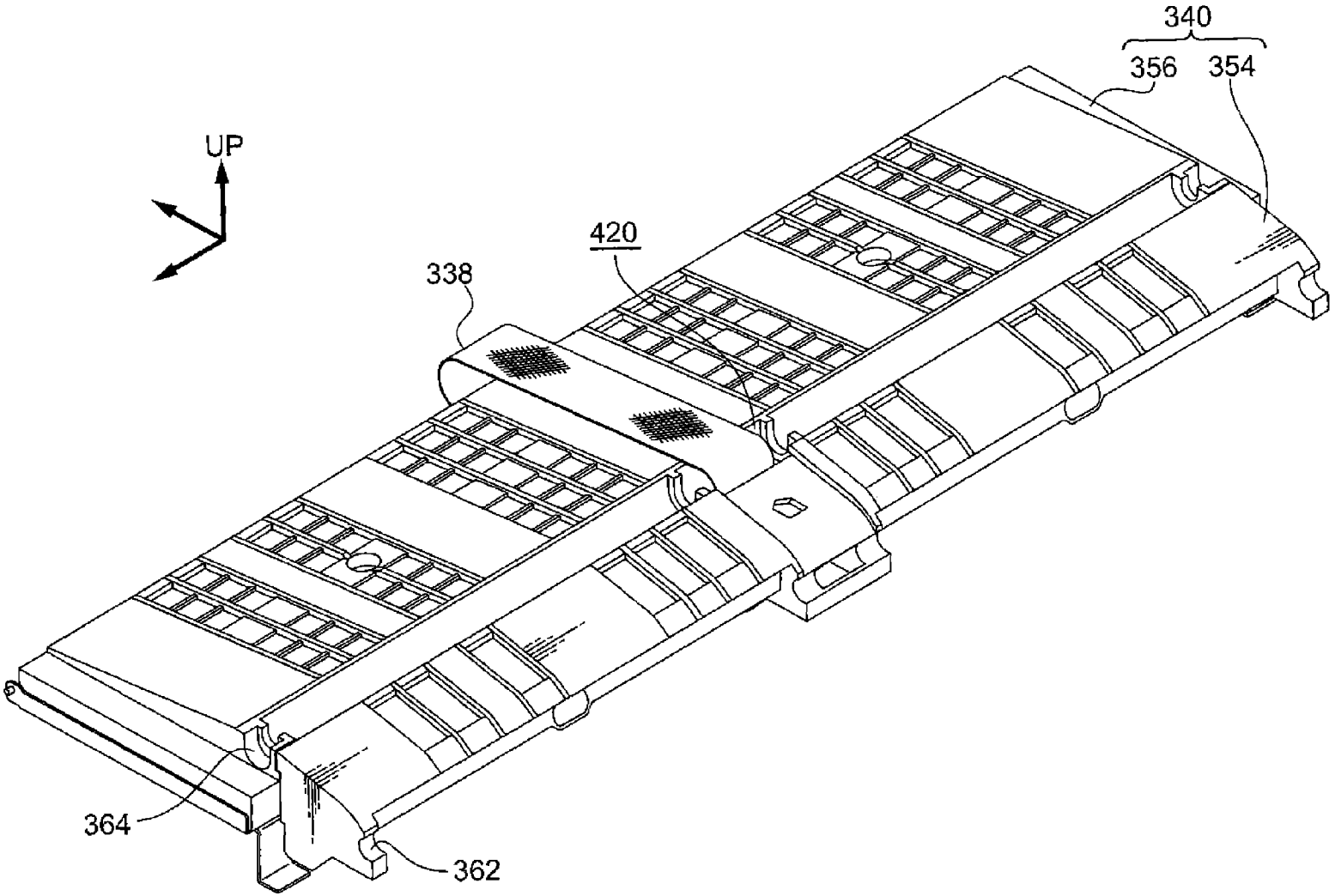
FIG. 22 is a perspective view showing the duct member and the endless belts and the like that are employed in the sheet material transporting device relating to the exemplary embodiment of the present invention.

Next, as shown in FIG. 22, the driven roller 332 is taken-out from the concave portions 362 formed in the upstream side duct member 354, and further, the driven roller 336 is taken-out from the concave portions 364 formed in the downstream side duct member 356. Then, the endless belts 334 provided at the both axial direction sides are moved in the axial direction and are taken-off from the duct member 340.

As shown in FIG. 23 and FIG. 24, the screws 422 are removed from the screw holes 426 of the downstream side duct member 356. The upstream side duct member 354 is separated from the downstream side duct member 356, and the concave portion 428 that is formed at the end portion of the downstream side duct member 356 is opened.

As shown in FIG. 25, in the state in which the concave portion 428 is open, the endless belt 338 is moved in the axial direction, and is taken-off of the downstream side duct member 356. Note that the tension of the endless belt 338 is lost because the driven roller 332 and the driven roller 336 have already been removed. Therefore, the endless belt 338 is taken-off of the downstream side duct member 356 without removing the tension imparting roller 396 that is provided at the bottom surface of the downstream side duct member 356.

When the endless belts 334, 338 are to be mounted to the duct member 340, the endless belts 334, 338 are mounted to the duct member 340 by processes in the order opposite to that described above.

As described above, when the upstream side duct member 354 is removed from the downstream side duct member 356, by separating the duct member 340 such that the concave portion 428 provided at the downstream side duct member 356 is open, the removal workability and the installation workability of the endless belt 338 improve as compared with a case in which the concave portion 428 is not opened.

Further, as described above, the peripheral direction length of the endless belt 338 is made to be longer than the peripheral direction length of the general portion (the portion at which the concave portion 428 is not formed) of the downstream side duct member 356, in order for the endless belt 338 to be able to pass through the general portion of the downstream side duct member 356 at the time of installing the endless belt 338. Therefore, by providing the tension imparting roller 396 that imparts tension to the endless belt 338, tension is imparted to the endless belt 338 without abrading the inner peripheral surface of the endless belt 338.

What is claimed is:

1. A sheet material transporting device comprising:

a plurality of first endless belts that is formed by band-shaped material;

a driving member that, by rotating, circulates the first endless belts, the plurality of first endless belts being looped around the driving member and aligned in an axial direction of the driving member;

a first driven member that is slave-rotated in conjunction with circulation of the first endless belts, the plurality of first endless belts being looped around the first driven member and aligned in an axial direction of the first driven member;

a supporting member that supports the driving member at a downstream side in a sheet material transporting direction and the first driven member at an upstream side in the sheet material transporting direction, the supporting member being provided at an inner peripheral side of the first endless belts;

a second endless belt that is provided between the first endless belts and circulated by the driving member, the second endless belt being formed by a band-shaped material and looped around the driving member;

a second driven member that is provided between the first driven member and the driving member and slave-rotated in conjunction with circulation of the second endless belt, the second endless belt being looped around the second driven member at an opening portion of the supporting member; and a detecting member that detects a sheet material that is transported, the detecting member being provided between the first driven member and the second driven member and between the first endless belts, and being fixed to the supporting member, wherein the supporting member includes a downstream side supporting member that is disposed at a downstream side in the sheet material transporting direction and has a concave portion formed in an end portion thereof, and an upstream side supporting member that is disposed at an upstream side in the sheet material transporting direction and abutted against the end portion of the downstream side supporting member such that the concave portion forms the opening portion, and a tension imparting section that imparts tension to the second endless belt is provided at the downstream side supporting member.

2. The sheet material transporting device of claim 1, wherein the tension imparting section is a tension imparting member that is slave-rotated in conjunction with circulation of the second endless belt.

3. The sheet material transporting device of claim 2, wherein a length in a peripheral direction of the second endless belt is longer than an outer peripheral length of the downstream side supporting member at a portion where the concave portion is not formed.

4. The sheet material transporting device of claim 1, wherein the first driven member is supported at the upstream side supporting member at an upstream side in the sheet material transporting direction, and the driving member is supported at the downstream side supporting member at a downstream side in the sheet material transporting direction.

5. The sheet material transporting device of claim 1, wherein the tension imparting section is provided so as to protrude from a surface of the downstream side supporting member that is opposite to a surface at which the sheet is transported.

6. The sheet material transporting device of claim 3, wherein the tension imparting member is provided so as to protrude from a surface of the downstream side supporting member that is opposite to a surface at which the sheet is transported.

7. The sheet material transporting device of claim 1, wherein the downstream side supporting member and the upstream side supporting member are separable.

8. The sheet material transporting device of claim 7, wherein the end portion of the downstream side supporting member at which the concave portion is formed is the end portion at the upstream side in the sheet material transporting direction, and in a state where the end portion of the downstream side supporting member at the upstream side in the sheet material transporting direction and an end portion of the upstream side supporting member at the downstream side in the sheet material transporting direction are abutted so as to assemble the downstream side supporting member and the upstream side supporting member, the concave portion formed at the downstream side supporting member forms the opening portion of the assembled downstream side supporting member and upstream side supporting member.

9. An image forming device comprising:

a fixing unit that applies heat and pressure while transporting a sheet material on which a toner image is formed, and fixes the toner image on the sheet material; and a sheet material transporting device that is disposed at a downstream side in a sheet material transporting direction with respect to the fixing unit, the sheet material transporting device including:

a plurality of first endless belts that is formed by band-shaped material;

a driving member that, by rotating, circulates the first endless belts, the plurality of first endless belts being looped around the driving member and aligned in an axial direction of the driving member;

a first driven member that is slave-rotated in conjunction with circulation of the first endless belts, the plurality of first endless belts being looped around the first driven member and aligned in an axial direction of the first driven member;

a supporting member that supports the driving member at a downstream side in the sheet material transporting direction and the first driven member at an upstream side in the sheet material transporting direction, the supporting member being provided at an inner peripheral side of the first endless belts;

a second endless belt that is provided between the first endless belts and circulated by the driving member, the second endless belt being formed by a band-shaped material and looped around the driving member;

a second driven member that is provided between the first driven member and the driving member and slave-rotated in conjunction with circulation of the second endless belt, the second endless belt being looped around the second driven member at an opening portion of the supporting member; and a detecting member that detects the sheet material that is transported, the detecting member being provided between the first driven member and the second driven member and between the first endless belts, and being fixed to the supporting member, wherein the supporting member includes a downstream side supporting member that is disposed at a downstream side in the sheet material transporting direction and has a concave portion formed in an end portion thereof, and an upstream side supporting member that is disposed at an upstream side in the sheet material transporting direction and abutted against the end portion of the downstream side supporting member such that the concave portion forms the opening portion, and a tension imparting section that imparts tension to the second endless belt is provided at the downstream side supporting member.

10. The image forming device of claim 9, wherein the tension imparting section is a tension imparting member that is slave-rotated in conjunction with circulation of the second endless belt.

11. The image forming device of claim 10, wherein a length in a peripheral direction of the second endless belt is longer than an outer peripheral length of the downstream side supporting member at a portion where the concave portion is not formed.

12. The image forming device of claim 9, wherein the first driven member is supported at the upstream side supporting member at an upstream side in the sheet material transporting direction, and the driving member is supported at the downstream side supporting member at a downstream side in the sheet material transporting direction.

13. The image forming device of claim 9, wherein the tension imparting section is provided so as to protrude from a surface of the downstream side supporting member that is opposite to a surface at which the sheet is transported.

14. The image forming device of claim 11, wherein the tension imparting member is provided so as to protrude from a surface of the downstream side supporting member that is opposite to a surface at which the sheet is transported.

15. The image forming device of claim 9, wherein the downstream side supporting member and the upstream side supporting member are separable.

16. The image forming device of claim 15, wherein the end portion of the downstream side supporting member at which the concave portion is formed is the end portion at the upstream side in the sheet material transporting direction, and in a state where the end portion of the downstream side supporting member at the upstream side in the sheet material transporting direction and an end portion of the upstream side supporting member at the downstream side in the sheet material transporting direction are abutted so as to assemble the downstream side supporting member and the upstream side supporting member, the concave portion formed at the downstream side supporting member forms the opening portion of the assembled downstream side supporting member and upstream side supporting member.

* * * * *